US006084616A

United States Patent [19]

Nakata et al.

[11] Patent Number: 6,084,616

[45] Date of Patent: Jul. 4, 2000

[54] LIQUID EJECTING HEAD, LIQUID EJECTING DEVICE AND LIQUID EJECTING METHOD

[75] Inventors: Yoshie Nakata, Kawasaki; Toshio Kashino, Chigasaki; Takeshi Okazaki, Sagamihara; Aya Yoshihira; Kiyomitsu Kudo, both of Yokohama, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/638,101

[22] Filed: Apr. 26, 1996

[30] Foreign Application Priority Data

Apr. 26, 1995 [JP] Japan ..... 7-127318

[51] Int. Cl.[7] ..... B41J 2/05

[52] U.S. Cl. ..... 347/65

[58] Field of Search ..... 347/65, 63, 15, 347/7, 85

[56] References Cited

U.S. PATENT DOCUMENTS

| | | | |
|---|---|---|---|
| 4,109,282 | 8/1978 | Robertson | 347/15 |
| 4,480,259 | 10/1984 | Kruger et al. | 347/63 |
| 4,494,128 | 1/1985 | Vaught | 347/15 X |
| 4,723,129 | 2/1988 | Endo et al. | 347/56 |
| 5,278,585 | 1/1994 | Karz et al. | 347/65 |
| 5,371,529 | 12/1994 | Eguchi | 347/7 |
| 5,581,287 | 12/1996 | Baezner | 347/85 |
| 5,821,962 | 10/1998 | Kudo | 347/65 |

FOREIGN PATENT DOCUMENTS

| | | | |
|---|---|---|---|
| 0 436 047 | 7/1991 | European Pat. Off. | B41J 2/055 |
| 0 538 147 | 4/1993 | European Pat. Off. | B41J 2/195 |
| 0 655 337 | 5/1995 | European Pat. Off. | B41J 2/205 |
| 33 32 555 | 3/1984 | Germany | B41J 3/04 |
| 55-081172 | 6/1980 | Japan | B41J 3/04 |
| 61-069467 | 4/1986 | Japan | B41J 3/04 |
| 63-199972 | 8/1988 | Japan | B41J 3/04 |
| 5-124189 | 5/1993 | Japan | B41J 2/05 |
| 5-169663 | 7/1993 | Japan | B41J 2/05 |
| 6-71881 | 3/1994 | Japan | B41J 2/045 |
| 6-71887 | 3/1994 | Japan | B41J 2/05 |
| 6-246935 | 9/1994 | Japan | B41J 2/21 |

*Primary Examiner*—John Barlow
*Assistant Examiner*—Juanita Stephens
*Attorney, Agent, or Firm*—Fitzpatrick, Cella, Harper & Scinto

[57] ABSTRACT

A liquid ejecting method includes providing a liquid ejection outlet; providing a first liquid flow path for first liquid in fluid communication with the liquid ejection outlet; providing a second liquid flow path for second liquid, adjacent to the first liquid flow path; providing a separation wall having a movable member between the first liquid flow path and the second liquid flow path; and ejecting, by displacement of the movable member toward the first liquid flow path, liquid which is a mixture of the first liquid and not less than 10% by weight of the second liquid on the basis of the amount of the first liquid.

25 Claims, 20 Drawing Sheets

FIG. 8(a)
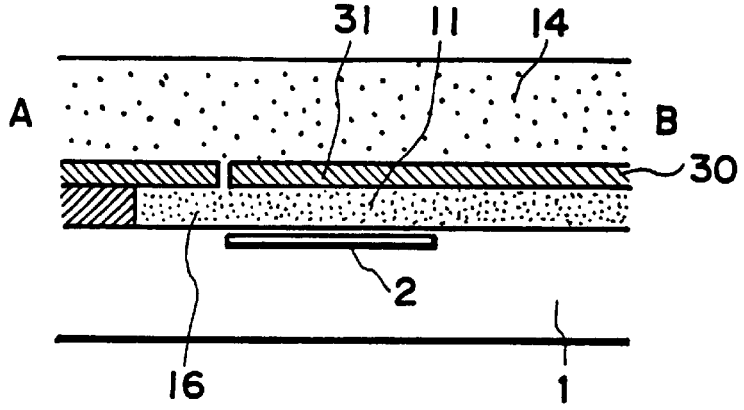
FIG. 8(b)
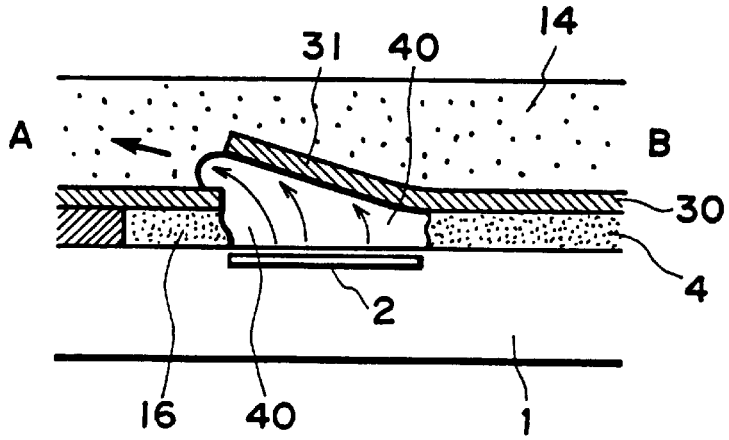
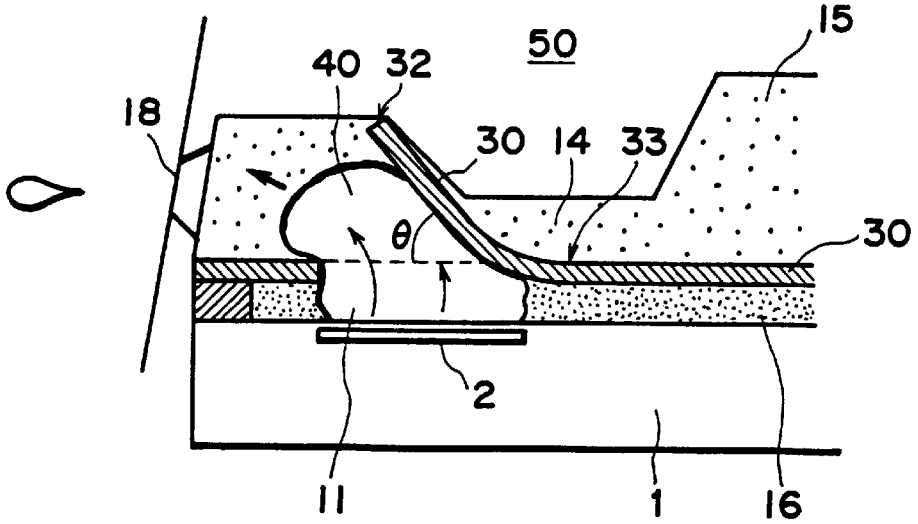
FIG. 9

LIQUID EJECTING HEAD, LIQUID EJECTING DEVICE AND LIQUID EJECTING METHOD

FIELD OF THE INVENTION AND RELATED ART

The present invention relates to a liquid ejecting head for ejecting desired liquid using generation of a bubble by applying thermal energy to the liquid, a head cartridge using the liquid ejecting head, a liquid ejecting device using the same, a manufacturing method for the liquid ejecting head, a liquid ejecting method, a recording method, and a print provided using the liquid ejecting method. It further relates to an ink jet head kit containing the liquid ejection head, and a method of filling the liquid ejection head with the liquid.

More particularly, it relates to a liquid ejecting head having a movable member movable by generation of a bubble, and a head cartridge using the liquid ejecting head, and liquid ejecting device using the same. It further relates to a liquid ejecting method and recording method for ejection the liquid by moving the movable member using the generation of the bubble.

The present invention is applicable to equipment such as a printer, a copying machine, a facsimile machine having a communication system, a word processor having a printer portion or the like, and an industrial recording device combined with various processing device or processing devices, in which the recording is effected on a recording material such as paper, thread, fiber, textile, leather, metal, plastic resin material, glass, wood, ceramic and so on.

In this specification, "recording" means not only forming an image of letter, figure or the like having specific meanings, but also includes forming an image of a pattern not having a specific meaning.

An ink jet recording method of so-called bubble jet type is known in which an instantaneous state change resulting in an instantaneous volume change (bubble generation) is caused by application of energy such as heat to the ink, so as to eject the ink through the ejection outlet by the force resulted from the state change by which the ink is ejected to and deposited on the recording material to form an image. As disclosed in U.S. Pat. No. 4,723,129, a recording device using the bubble jet recording method comprises an ejection outlet for ejecting the ink, an ink flow path in fluid communication with the ejection outlet, and an electrothermal transducer as energy generating means disposed in the ink flow path.

Such a recording method is advantageous in that a high quality image can be recorded at high speed and with low noise, and a plurality of such ejection outlets can be positioned at high density, and therefore, small size recording apparatus capable of providing a high resolution can be provided, and color images can be easily formed. Therefore, the bubble jet recording method is now widely used in printers, copying machines, facsimile machines or other office equipment, and for industrial systems such as textile printing devices or the like.

With the increase of the wide needs for the bubble jet technique, various demands are imposed thereon, recently.

For example, an improvement in energy use efficiency is demanded. To meet the demand, the optimization of the heat generating element such as adjustment of the thickness of the protecting film is investigated. This method is effective in that a propagation efficiency of the generated heat to the liquid is improved.

In order to provide high image quality images, driving conditions have been proposed by which the ink ejection speed is increased, and/or the bubble generation is stabilized to accomplish better ink ejection. As another example, from the standpoint of increasing the recording speed, flow passage configuration improvements have been proposed by which the speed of liquid filling (refilling) into the liquid flow path is increased.

Japanese Laid Open Patent Application No. SHO-63-199972 proposes flow passage structures.

The liquid path or passage structure of a manufacturing method therefor are proposed from the standpoint of the back wave toward the liquid chamber. This back wave is considered as energy loss since it does not contribute to the liquid ejection. It proposes a valve 10 disposed upstream of the heat generating element 2 with respect to the direction of general flow of the liquid, and is mounted on the ceiling of the passage. It takes an initial position wherein it extends along the ceiling. Upon bubble generation, it takes the position wherein it extends downwardly, thus suppressing a part of the back wave by the valve 10. When the valve is generated in the path 3, the suppression of the back wave is not practically significant. The back wave is not directly contributable to the ejection of the liquid. through the back wave occurs in the path, the pressure for directly ejecting the liquid already makes the liquid ejectable from the passage.

On the other hand, in the bubble jet recording method, the heating is repeated with the heat generating element contacted with the ink, and therefore, a burnt material is deposited on the surface of the heat generating element due to kogation of the ink. However, the amount of the deposition may be large depending on the materials of the ink. if this occurs, the ink ejection becomes unstable. Additionally, even when the liquid to be ejected is the one easily deteriorated by heat or even when the liquid is the one with which the bubble generation is not sufficient, the liquid is desired to be ejected in good order without property change.

Japanese Laid Open Patent Application No. SHO-61-69467, Japanese Laid Open Patent Application No. SHO-55-81172 and U.S. Pat. No. 4,480,259 disclose that different liquids are used for the liquid generating the bubble by the heat (bubble generating liquid) and for the liquid to be ejected (ejection liquid). In these publications, the ink as the ejection liquid and the bubble generation liquid are completely separated by a flexible film of silicone rubber or the like so as to prevent direct contact of the ejection liquid to the heat generating element while propagating the pressure resulting from the bubble generation of the bubble generation liquid to the ejection liquid by the deformation of the flexible film. The prevention of the deposition of the material on the surface of the heat generating element and the increase of the selection latitude of the ejection liquid are accomplished, by such a structure.

However, with this structure in which the ejection liquid and the bubble generation liquid are completely separated, the pressure by the bubble generation is propagated to the ejection liquid through the expansion-contraction deformation of the flexible film, and therefore, the pressure is absorbed by the flexible film to a quite high degree. In addition, the deformation of the flexible film is not so large, and therefore, the energy use efficiency and the ejection force are deteriorated although the same effect is provided by the provision between the ejection liquid and the bubble generation liquid.

SUMMARY OF THE INVENTION

Accordingly, it is a principal object of the present invention to provide a liquid ejection principle with which the generated bubble is controlled in a novel manner.

It is another object of the present invention to further improve the system of the novel manner in ejection stability, ejection efficiency, and/or ejection property.

It is a further object of the present invention to provide a liquid ejecting method, liquid ejecting head and so on wherein heat accumulation in the liquid on the heat generating element is significantly reduced, and the residual bubble on the heat generating element is reduced, while improving the ejection efficiency and the ejection pressure.

It is a further object of the present invention to provide a liquid ejecting head and so on wherein inertia force in a direction against liquid supply direction due to back wave is suppressed, and simultaneously, a degree of retraction of a meniscus is reduced by a valve function of a movable member by which the refilling frequency is increased, thus permitting high speed printing.

It is a further object of the present invention to provide a liquid ejecting head and so on wherein deposition of residual material on the heat generating element is reduced, and the range of the usable liquid is widened, and in addition, the ejection efficiency and the ejection force are significantly increased.

It is a further object of the present invention to provide a liquid ejecting method, a liquid ejecting head and so on, wherein the choice of the liquid to be ejected is made greater.

It is a further object of the present invention to provide a manufacturing method for a liquid ejecting head with which such a liquid ejecting head is easily manufactured.

It is a further object of the present invention to provide a liquid ejecting head, a printing apparatus and so on which can be easily manufactured because a liquid introduction path for supplying a plurality of liquids is constituted with a small number of parts. it is an additional object to provide a downsized liquid ejecting head and device.

It is a further object of the present invention to provide a good print of an image using an above-described ejection method.

It is a further object of the present invention to provide a head kit for permitting easy reuse of the liquid ejecting head.

According to an aspect of the present invention, there is provided a liquid ejecting method, comprising the steps of: providing a liquid ejection outlet; providing a first liquid flow path for first liquid in fluid communication with the liquid ejection outlet; providing a second liquid flow path for second liquid, adjacent to the first liquid flow path; providing a separation wall having a movable member between the first liquid flow path and the second liquid flow path; and ejecting, by displacement of the movable member toward the first liquid flow path, liquid which is a mixture of the first liquid and not less than 10% by weight of the second liquid on the basis of the amount of the first liquid.

According to another aspect of the present invention there is provided a liquid ejection head, comprising: a liquid ejection outlet; a first liquid flow path for first liquid in fluid communication with the liquid ejection outlet; a second liquid flow path for second liquid, adjacent to the first liquid flow path; a separation wall having a movable member between the first liquid flow path and the second liquid flow path; and wherein by displacement of the movable member toward the first liquid flow path, liquid which is a mixture of the first liquid and not less than 10% by weight of the second liquid on the basis of the amount of the first liquid, is ejected through the liquid ejection outlet.

According to a further aspect of the present invention there is provided a liquid ejecting apparatus, comprising: a liquid ejecting head including; a liquid ejection outlet; a first liquid flow path for first liquid in fluid communication with the liquid ejection outlet; a second liquid flow path for second liquid, adjacent to the first liquid flow path; and a separation wall having a movable member between the first liquid flow path and the second liquid flow path; wherein by displacement of the movable member toward the first liquid flow path, liquid which is a mixture of the first liquid and not less than 10% by weight of the second liquid on the basis of the amount of the first liquid, is ejected through the liquid ejection outlet; and driving signal supply means for supplying a driving signal to the liquid ejecting head.

According to a further aspect of the present invention there is provided a liquid ejecting apparatus, comprising: a liquid ejecting head including; a liquid ejection outlet; a first liquid flow path for first liquid in fluid communication with the liquid ejection outlet; a second liquid flow path for second liquid, adjacent to the first liquid flow path; and a separation wall having a movable member between the first liquid flow path and the second liquid flow path; driving signal supply means for supplying to the liquid ejecting head a driving signal for ejecting, by displacement of the movable member toward the first liquid flow path, liquid which is a mixture of the first liquid and not less than 10% by weight of the second liquid on the basis of the amount of the first liquid, is ejected through the liquid ejection outlet.

According to a further aspect of the present invention there is provided a head cartridge, comprising: a liquid ejecting head including; a liquid ejection outlet; a first liquid flow path for first liquid in fluid communication with the liquid ejection outlet; a second liquid flow path for second liquid, adjacent to the first liquid flow path; and a separation wall having a movable member between the first liquid flow path and the second liquid flow path; wherein by displacement of the movable member toward the first liquid flow path, liquid which is a mixture of the first liquid and not less than 10% by weight of the second liquid on the basis of the amount of the first liquid, is ejected through the liquid ejection outlet; and liquid container for containing the liquid to be supplied to the liquid ejecting head.

According to a further aspect of the present invention there is provided a print provided by liquid ejected by a recording head comprising: a liquid ejection outlet; a first liquid flow path for first liquid in fluid communication with the liquid ejection outlet; a second liquid flow path for second liquid, adjacent to the first liquid flow path; a separation wall having a movable member between the first liquid flow path and the second liquid flow path; and wherein by displacement of the movable member toward the first liquid flow path, liquid which is a mixture of the first liquid and not less than 10% by weight of the second liquid on the basis of the amount of the first liquid, is ejected through the liquid ejection outlet.

According to a further aspect of the present invention there is provided a head kit comprising: a recording head including a liquid ejection outlet; a first liquid flow path for first liquid in fluid communication with the liquid ejection outlet; a second liquid flow path for second liquid, adjacent to the first liquid flow path; a separation wall having a movable member between the first liquid flow path and the second liquid flow path; and wherein by displacement of the movable member toward the first liquid flow path, liquid which is a mixture of the first liquid and not less than 10% by weight of the second liquid on the basis of the amount of the first liquid, is ejected through the liquid ejection outlet; a liquid container for containing liquid to be supplied to the liquid ejecting head; and a filling portion, containing the liquid, for filling the liquid to the liquid container.

According to a further aspect of the present invention there is provided a liquid filling method, comprising: preparing recording head including a liquid ejection outlet; a first liquid flow path for first liquid in fluid communication with the liquid ejection outlet; a second liquid flow path for second liquid, adjacent to the first liquid flow path; a separation wall having a movable member between the first liquid flow path and the second liquid flow path; and wherein by displacement of the movable member toward the first liquid flow path, liquid which is a mixture of the first liquid and not less than 10% by weight of the second liquid on the basis of the amount of the first liquid, is ejected through the liquid ejection outlet; wherein the liquid is filled to both of the first liquid flow path and the second liquid flow path.

According to a further aspect of the present invention there is provided a tone gradation recording method, comprising: providing a liquid ejection outlet; providing a first liquid flow path for first liquid in fluid communication with the liquid ejection outlet; providing a second liquid flow path for second liquid, adjacent to the first liquid flow path; providing a separation wall having a movable member between the first liquid flow path and the second liquid flow path; and ejecting, by displacement of the movable member toward the first liquid flow path, liquid which is a mixture of the first liquid and an amount of the second liquid on the basis of the amount of the first liquid, wherein the amount is controlled in accordance with the tone level to be recorded.

According to a further aspect of the present invention there is provided a tone recording apparatus comprising: a liquid ejection outlet; a first liquid flow path for first liquid in fluid communication with the liquid ejection outlet; a second liquid flow path for second liquid, adjacent to the first liquid flow path; a separation wall having a movable member between the first liquid flow path and the second liquid flow path; and wherein by displacement of the movable member toward the first liquid flow path, liquid which is a mixture of the first liquid and an amount of the second liquid on the basis of the amount of the first liquid, is ejected, wherein the amount is controlled in accordance with the tone level to be recorded.

With the liquid ejecting method and the head using the novel ejection principle, a synergistic effect is provided by the generated bubble and the movable member moved thereby so that the liquid adjacent the ejection outlet can be ejection with high efficiency, and therefore, the ejection efficiency is improved. For example, in the most desirable type of the present invention, the ejection efficiency is increased even to twice the conventional one.

In another aspect of the present invention, even if the printing operation is started after the recording head is left in a low temperature or low humidity condition for a long term, the ejection failure can be avoided. Even if the ejection failure occurs, the normal operation is recovered by a small scale recovery process including a preliminary ejection and sucking recovery.

In an aspect of improving the refilling property, the responsivity, the stabilized growth of the bubble and stabilization of the liquid droplet during the continuous ejections are accomplished, thus permitting high speed recording.

In this specification, "upstream" and "downstream" are defined with respect to a general liquid flow from a liquid supply source to the ejection outlet through the bubble generation region (movable member).

As regards the bubble per se, the "downstream" is defined as toward the ejection outlet side of the bubble which directly functions to eject the liquid droplet. More particularly, it generally means downstream from the center of the bubble with respect to the direction of the general liquid flow, or downstream from the center of the area of the heat generating element with respect to the same.

In this specification, "substantially sealed" generally means a sealed state in such a degree that when the bubble grows, the bubble does not escape through a gap (slit) around the movable member before motion of the movable member.

In this specification, "separation wall" may mean a wall (which may include the movable member) interposed to separate the region in direct fluid communication with the ejection outlet from the bubble generation region, and more specifically means a wall separating the flow path including the bubble generation region from the liquid flow path in direct fluid communication with the ejection outlet, thus preventing mixture of the liquids in the liquid flow paths.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 8(*a*)–8(*b*) are illustrations of an operation of a movable member.

FIG. 9 is an illustration of a structure of a second liquid flow path and a movable member.

DESCRIPTION OF THE PREFERRED EMBODIMENT

Embodiment 1

Referring to the accompanying drawings, the embodiments of the present invention will be described.

Figure 4:
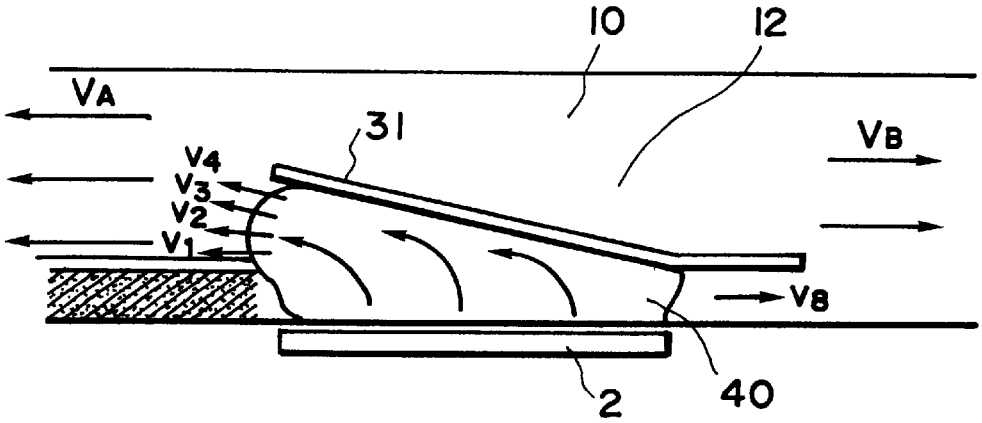
FIG. 4 is a schematic view of pressure propagation from a bubble in a head according to an embodiment of the present invention.

In this embodiment, the description will be made as to an improvement in an ejection force and/or an ejection efficiency by controlling a direction of propagation of pressure resulting from generation of a bubble for ejecting the liquid and controlling a direction of growth of the bubble. FIG. 1 is a schematic sectional view of a liquid ejecting head taken along a liquid flow path according to this embodiment, and FIG. 4 is a partly broken perspective view of the liquid ejecting head.

The liquid ejecting head of this embodiment comprises a heat generating element 2 (a heat generating resistor of 40 μm×105 μm in this embodiment) as the ejection energy generating element for supplying thermal energy to the liquid to eject the liquid, an element substrate 1 on which said heat generating element 2 is provided, and a liquid flow path 10 formed above the element substrate correspondingly to the heat generating element 2. The liquid flow path 10 is in fluid communication with a common liquid chamber 13 for supplying the liquid to a plurality of such liquid flow paths 10 which is in fluid communication with a plurality of the ejection outlets 18.

Above the element substrate in the liquid flow path 10, a movable member or plate 31 in the form of a cantilever of an elastic material such as metal is provided faced to the heat generating element 2. One end of the movable member is fixed to a foundation (supporting member) 34 or the like provided by patterning of photosensitive resin material on the wall of the liquid flow path 10 or the element substrate. By this structure, the movable member is supported, and a fulcrum (fulcrum portion) is constituted.

The movable member 31 is so positioned that it has a fulcrum (fulcrum portion which is a fixed end) 33 in an upstream side with respect to a general flow of the liquid from the common liquid chamber 13 toward the ejection outlet 18 through the movable member 31 caused by the ejecting operation and that it has a free end (free end portion) 32 in a downstream side of the fulcrum 33, the movable member 31 is faced to the heat generating element 2 with a gap of 15 μm approx. as if it covers the heat generating element 2. A bubble generation region is constituted between the heat generating element and movable member. The type, configuration or position of the heat generating element or the movable member is not limited to the ones described above, but may be changed as long as the growth of the bubble and the propagation of the pressure can be controlled. For the purpose of easy understanding of the flow of the liquid which will be described hereinafter, the liquid flow. path 10 is divided by the movable member 31 into a first liquid flow path 14 which is directly in communication with the ejection outlet 18 and a second liquid flow path 16 having the bubble generation region 11 and the liquid supply port 12.

Figure 1A:
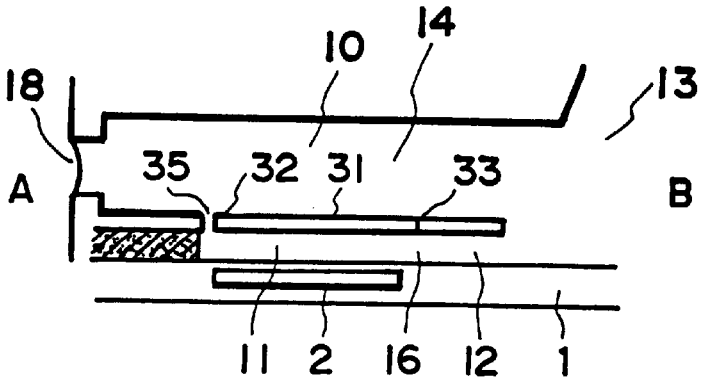
FIGS. 1(*a*)–1(*d*) are a schematic sectional view of an example of a liquid ejecting head of an embodiment of the present invention.
Figure 1B:
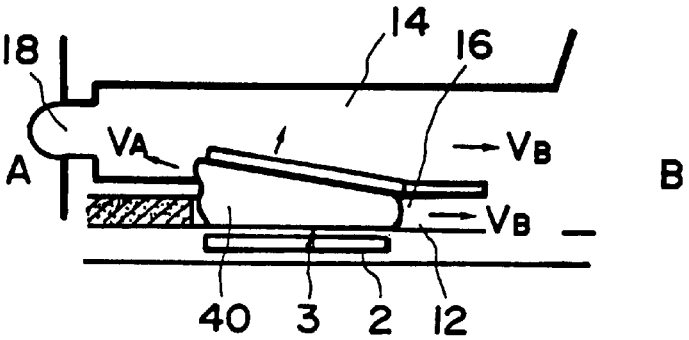
Figure 1C:
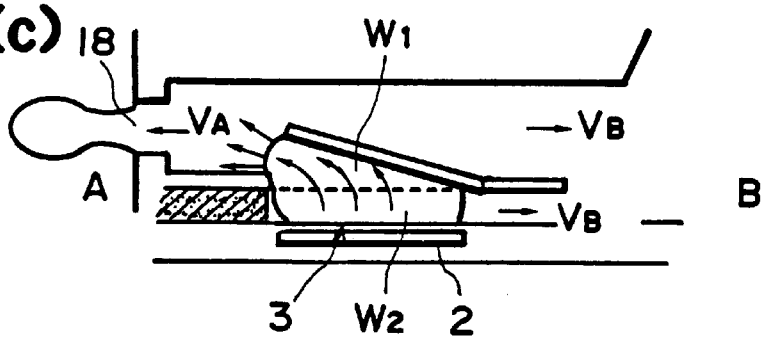
Figure 1D:
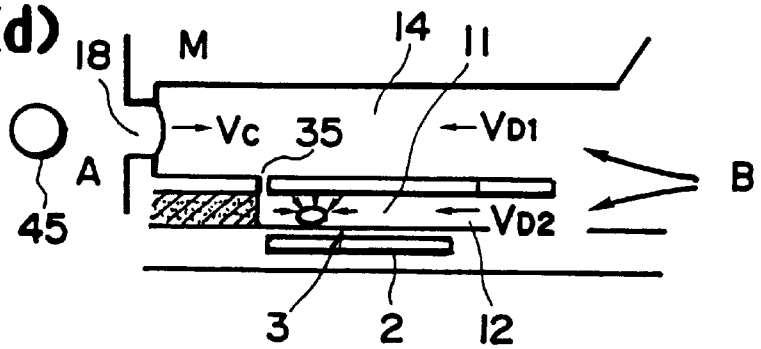
Figure 2:
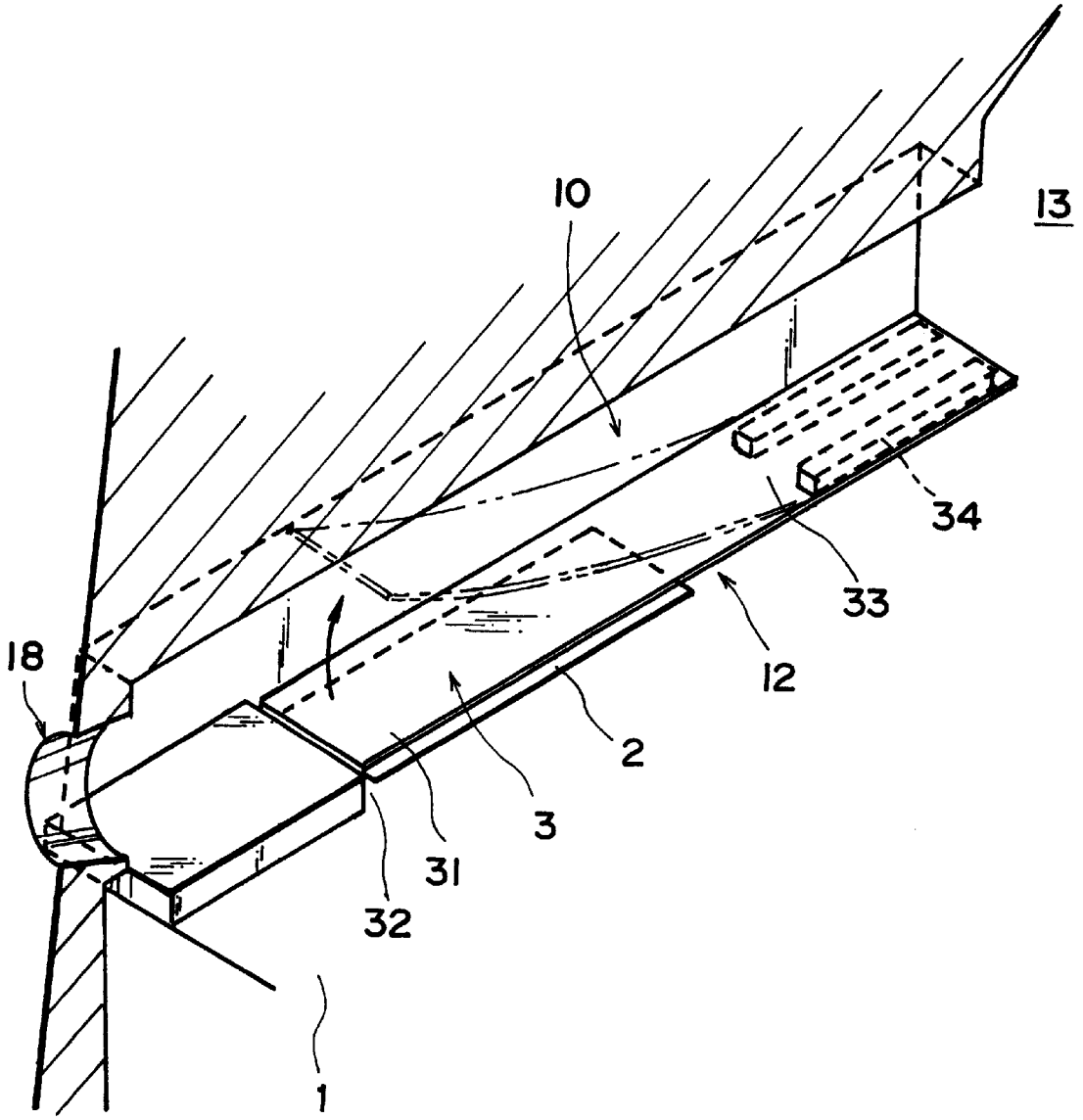
FIG. 2 is a partly broken perspective view of a liquid ejecting head according to an embodiment of the present invention.

By causing heat generation of the heat generating element 2, the heat is applied to the liquid in the bubble generation region 11 between the movable member 31 and the heat generating element 2, by which a bubble is generated by the film boiling phenomenon as disclosed in U.S. Pat. No. 4,723,129. The bubble and the pressure caused by the generation of the bubble act mainly on the movable member, so that the movable member 31 moves or displaces to widely open toward the ejection outlet side about the fulcrum 33, as shown in FIGS. 1(*a*) and 1(*c*) or in FIG. 2. By the displacement of the movable member 31 or the state after the displacement, the propagation of the pressure caused by the generation of the bubble and the growth of the bubble per se are directed toward the ejection outlet.

Here, one of the fundamental ejection principles according to the present invention will be described. One of important principles of this invention is that the movable member disposed faced to the bubble is displaced from the normal first position to the displaced second position on the basis of the pressure of the bubble generation or the bubble per se, and the displacing or displaced movable member 31 is effective to direct the pressure produced by the generation of the bubble and/or the growth of the bubble per se toward the ejection outlet 18 (downstream side).

More detailed description will be made with comparison between the conventional liquid flow passage structure not using the movable member (FIG. 3) and the present invention (FIG. 4). Here, the direction of propagation of the pressure toward the ejection outlet is indicated by $V_A$, and the direction of propagation of the pressure toward the upstream is indicated by $V_B$.

Figure 3:
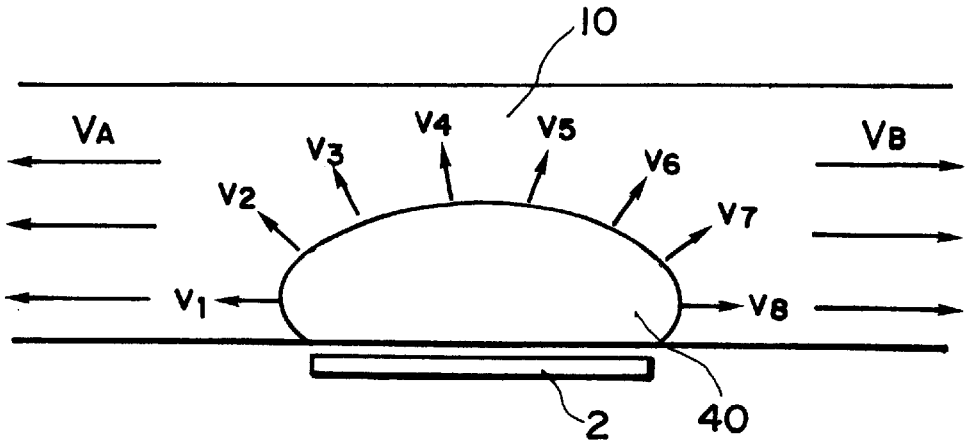
FIG. 3 is a schematic view of pressure propagation from a bubble in a conventional head.

In a conventional head as shown in FIG. 3, there is not any structural element effective to regulate the direction of the propagation of the pressure produced by the bubble 40 generation. Therefore, the direction of the pressure propagation of the bubble is normal to the surface of the bubble as indicated by V1–V8, and therefore, is widely directed in the passage. Among these directions, those of the pressure propagation from the half portion of the bubble closer to the ejection outlet (V1–V4) have the pressure components in the $V_A$ direction which is most effective for the liquid ejection. This portion is important since it directly contributable to the liquid ejection efficiency, the liquid ejection pressure and the ejection speed. Furthermore, the component V1 is closest to the direction of $V_A$ which is the ejection direction, and therefore, is most effective, and the V4 has a relatively small component in the direction $V_A$.

On the other hand, in the case of the present invention, shown in FIG. 4, the movable member 31 is effective to direct, to the downstream (ejection outlet side), the pressure propagation directions V1–V4 of the bubble which otherwise are toward various directions. Thus, the pressure propagations of bubble 40 are concentrated, so that the pressure of the bubble 40 is directly and efficiently contributable to the ejection.

The growth direction per se of the bubble is directed downstream similarly to to the pressure propagation directions V1–V4, and grow more in the downstream side than in the upstream side. Thus, the growth direction per se of the bubble is controlled by the movable member, and the pressure propagation direction from the bubble is controlled thereby, so that the ejection efficiency, ejection force and ejection speed or the like are fundamentally improved.

Referring back to FIG. 1, the ejecting operation of the liquid ejecting head in this embodiment will be described in detail.

FIG. 1(*b*) shows a state before the energy such as electric energy is applied to the heat generating element 2, and therefore, no heat has yet been generated. It should be noted that the movable member 31 is so positioned as to be faced at least to the downstream portion of the bubble generated by the heat generation of the heat generating element. In other words, in order that the downstream portion of the bubble acts on the movable member, the liquid flow passage structure is such that the movable member 31 extends at least to the position downstream (downstream of a line passing through the center 3 of the area of the heat generating element and perpendicular to the length of the flow path) of the center 3 of the area of the heat generating element.

FIG. 1(*b*) shows a state wherein the heat generation of heat generating element 2 occurs by the application of the electric energy to the heat generating element 2, and a part of of the liquid filled in the bubble generation region 11 is heated by the thus generated heat so that a bubble is generated through the film boiling.

At this time, the movable member 31 is displaced from the first position to the second position by the pressure produced by the generation of the bubble 40 so as to guide the propagation of the pressure toward the ejection outlet. It should be noted that, as described hereinbefore, the free end 32 of the movable member 31 is disposed in the downstream side (ejection outlet side), and the fulcrum 33 is disposed in the upstream side (common liquid chamber side), so that at least a part of the movable member is faced to the downstream portion of the bubble, that is, the downstream portion of the heat generating element.

FIG. 1(*c*) shows a state in which the bubble 40 has further grown. By the pressure resulting from the bubble 40 generation, the movable member 31 is displaced further. The generated bubble grows more downstream than upstream, and it expands greatly beyond a first position (broken line position) of the movable member. Thus, it is understood that in accordance with the growth of the bubble 40, the movable member 31 gradually displaces, by which the pressure propagation direction of the bubble 40, the direction in which the volume movement is easy, namely, the growth direction of the bubble, are directed uniformly toward the ejection outlet, so that the ejection efficiency is increased. When the movable member guides the bubble and the bubble generation pressure toward the ejection outlet, it hardly obstructs propagation and growth, and can efficiently control the propagation direction of the pressure and the growth direction of the bubble in accordance with the degree of the pressure.

FIG. 1(*d*) shows a state wherein the bubble 40 contracts and disappears by the decrease of the pressure in the bubble, peculiar to the film boiling phenomenon.

The movable member 31 having been displaced to the second position returns to the initial position (first position) of FIG. 1(*a*) by the restoring force provided by the spring property of the movable member per se and the negative pressure due to the contraction of the bubble. Upon the collapse of bubble, the liquid flows back from the common liquid chamber side as indicated by $V_{D1}$ and $V_{D2}$ and from the ejection outlet side as indicated by $V_c$ so as to compensate for the volume reduction of the bubble in the bubble generation region 11 and to compensate for the volume of the ejected liquid.

In the foregoing, the description has been made as to the operation of the movable member with the generation of the bubble and the ejecting operation of the liquid. Now, the description will be made as to the refilling of the liquid in the liquid ejecting head of the present invention.

Referring to FIG. 1, liquid supply mechanism will be described.

When the bubble 40 enters the bubble collapsing process after the maximum volume thereof after FIG. 1(*c*) state, a volume of the liquid enough to compensate for the collapsing bubble volume flows into the bubble generation region from the ejection outlet 18 side of the first liquid flow path 14 and from the bubble generation region of the second liquid flow path 16.

In the case of conventional liquid flow passage structure not having the movable member 31, the amount of the liquid from the ejection outlet side to the bubble collapse position and the amount of the liquid from the common liquid chamber thereinto, are attributable to the flow resistances of the portion closer to the ejection outlet than the bubble generation region and the portion closer to the common liquid chamber.

Therefore, when the flow resistance at the supply port side is smaller than the other side, a large amount of the liquid flows into the bubble collapse position from the ejection outlet side with the result that the meniscus retraction is large. With the reduction of the flow resistance in the ejection outlet for the purpose of increasing the ejection efficiency, the meniscus M retraction increases upon the collapse of bubble with the result of longer refilling time period, thus making high speed printing difficult.

According to this embodiment, because of the provision of the movable member 31, the meniscus retraction stops at the time when the movable member returns to the initial position upon the collapse of bubble, and thereafter, the supply of the liquid to fill a volume W2 is accomplished by the flow $V_{D2}$ through the second flow path 16 (W1 is a volume of an upper side of the bubble volume W beyond the first position of the movable member 31, and W2 is a volume of a bubble generation region 11 side thereof). In the prior art, a half of the volume of the bubble volume W is the volume of the meniscus retraction, but according to this embodiment, only about one half (W1) is the volume of the meniscus retraction.

Addition ally, the liquid supply for the volume W2 is forced to be effected mainly from the upstream ($V_{D2}$) of the second liquid flow path along the surface of the heat generating element side of the movable member 31 using the pressure upon the collapse of bubble, and therefore, more speedy refilling action is accomplished.

When the refilling using the pressure upon the collapse of bubble is carried out in a conventional head, the vibration of the meniscus is expanded with the result of the deterioration of the image quality. However, according to this embodiment, the flows of the liquid in the first liquid flow path 14 at the ejection outlet side and the ejection outlet side of the bubble generation region 11 are suppressed, so that the vibration of the meniscus is reduced.

Thus, according to this embodiment, the high speed refilling is accomplished by the forced refilling to the bubble generation region through the liquid supply passage 12 of the second flow path 16 and by the suppression of the meniscus retraction and vibration. Therefore, the stabilization of ejection and high speed repeated ejections are accomplished, and when the embodiment is used in the field of recording, the improvement in the image quality and in the recording speed can be accomplished.

The embodiment provides the following effective function. It is a suppression of the propagation of the pressure to the upstream side (back wave) produced by the generation of the bubble. The pressure due to the common liquid chamber 13 side (upstream) of the bubble generated on the heat generating element 2 mostly has resulted in force which pushes the liquid back to the upstream side (back wave). The back wave deteriorates the refilling of the liquid into the liquid flow path by the pressure at the upstream side, the resulting motion of the liquid and the resulting inertia force. In this embodiment, these actions to the upstream side are suppressed by the movable member 31, so that the refilling performance is further improved.

The description will be made as to a further characterizing feature and the advantageous effect.

The second liquid flow path 16 of this embodiment has a liquid supply passage 12 having an internal wall substantially flush with the heat generating element 2 (the surface of the heat generating element is not greatly stepped down) at the upstream side of the heat generating element 2. With this structure, the supply of the liquid to the surface of the heat generating element 2 and the bubble generation region 11 occurs along the surface of the movable member 31 at the position closer to the bubble generation region 11 as indicated by $V_{D2}$. Accordingly, stagnation of the liquid on the surface of the heat generating element 2 is suppressed, so that precipitation of the gas dissolved in the liquid is suppressed, and the residual bubbles not disappeared are removed without difficulty, and in addition, the heat accumulation in the liquid is not too much. Therefore, the stabilized bubble generation can be repeated at a high speed. In this embodiment, the liquid supply passage 12 has a substantially flat internal wall, but this is not limiting, and the liquid supply passage is satisfactory if it has an internal wall with such a configuration smoothly extended from the surface of the heat generating element that the stagnation of the liquid occurs on the heat generating element, and eddy flow is not significantly caused in the supply of the liquid.

The supply of the liquid into the bubble generation region may occur through a gap at a side portion of the movable member (slit 35) as indicated by $V_{D1}$. In order to direct the pressure upon the bubble generation further effectively to the ejection outlet, a large movable member covering the entirety of the bubble generation region (covering the surface of the heat generating element) may be used, as shown in FIG. 1. Then, the flow resistance for the liquid between the bubble generation region 11 and the region of the first liquid flow path 14 close to the ejection outlet is increased by the restoration of the movable member to the first position, so that the flow of the liquid to the bubble generation region 11 along $V_{D1}$ can be suppressed. However, according to the head structure of this embodiment, there is a flow effective to supply the liquid to the bubble generation region, the supply performance of the liquid is greatly increased, and therefore, even if the movable member 31 covers the bubble generation region 11 to improve the ejection efficiency, the supply performance of the liquid is not deteriorated.

Figure 5:
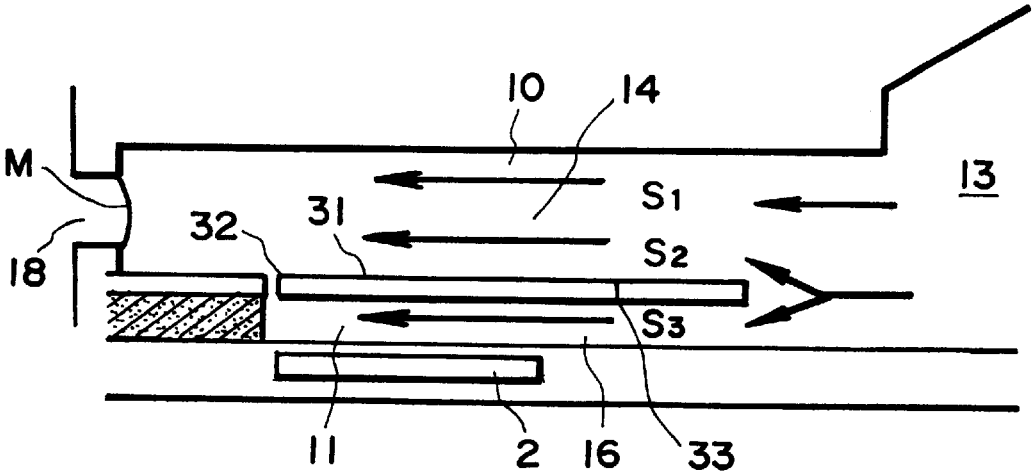
FIG. 5 is a schematic view of a liquid flow in an embodiment of the present invention.

The positional relation between the free end 32 and the fulcrum 33 of the movable member 31 is such that the free end is at a downstream position of the fulcrum as indicated by 6 in the Figure, for example. With this structure, the function and effect of guiding the pressure propagation direction and the direction of the growth of the bubble to the ejection outlet side or the like can be efficiently assured upon the bubble generation. Additionally, the positional relation is effective to accomplish not only the function or effect relating to the ejection but also the reduction of the flow resistance through the liquid flow path 10 upon the supply of the liquid thus permitting the high speed refilling. When the meniscus M retracted by the ejection as shown in FIG. 5, returns to the ejection outlet 18 by capillary force or when the liquid supply is effected to compensate for the collapse of bubble, the positions of the free end and the fulcrum 33 are such that the flows $S_1$, $S_2$ and $S_3$ through the liquid flow path 10 including the first liquid flow path 14 and the second liquid flow path 16, are not impeded.

More particularly, in this embodiment, as described hereinbefore, the free end 32 of the movable member 3 is faced to a downstream position of the center 3 of the area which divides the heat generating element 2 into an upstream region and a downstream region (the line passing through the center (central portion) of the area of the heat generating element and perpendicular to a direction of the length of the liquid flow path). The movable member 31 receives the pressure and the bubble which are greatly contributable to the ejection of the liquid at the downstream side of the area center position 3 of the heat generating element, and it guides the force to the ejection outlet side, thus fundamentally improving the ejection efficiency or the ejection force.

Further advantageous effects are provided using the upstream side of the bubble, as described hereinbefore.

Furthermore, it is considered that in the structure of this embodiment, the instantaneous mechanical movement of the free end of the movable member 31, contributes to the ejection of the liquid.

Figure 6:
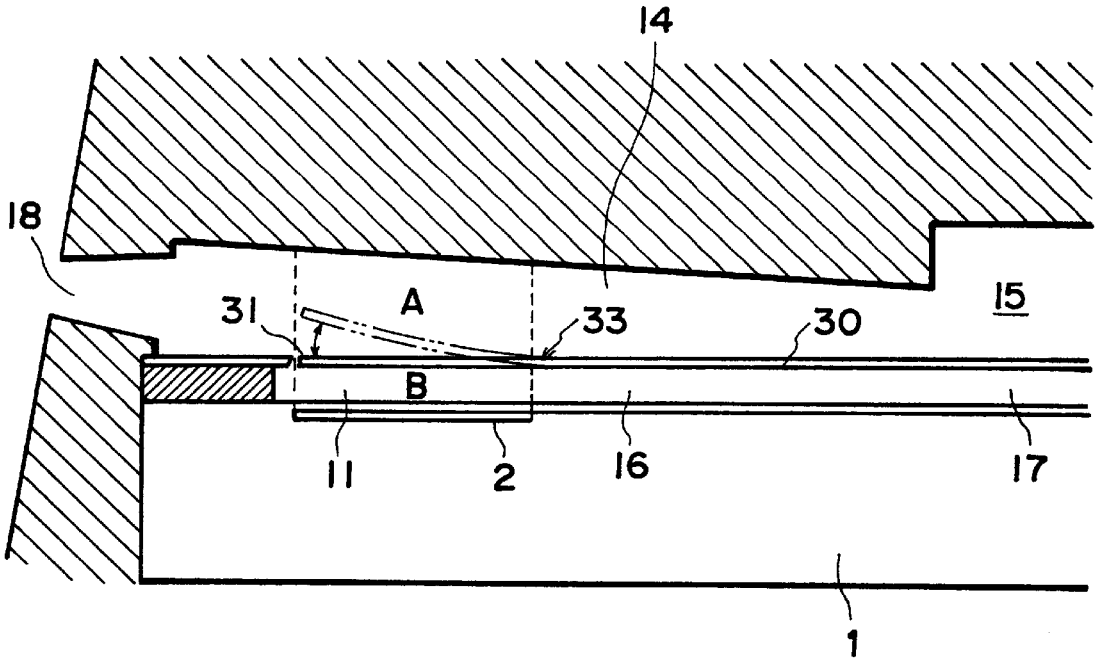
FIG. 6 is a sectional view of a liquid ejecting head (2 flow path) according to a sixth embodiment of the present invention.

FIG. 6 is a sectional schematic view in a direction along the flow path of the liquid ejecting head of this embodiment.

In the liquid ejecting head of this embodiment, a second liquid flow path 16 for the bubble generation is provided on the element substrate 1 which is provided with a heat generating element 2 for supplying thermal energy for generating the bubble in the liquid, and a first liquid flow path 14 for the ejection liquid in direct communication with the ejection outlet 18 is formed thereabove.

The upstream side of the first liquid flow path is in fluid communication with a first common liquid chamber 15 for supplying the ejection liquid into a plurality of first liquid flow paths, and the upstream side of the second liquid flow path is in fluid communication with the second common liquid chamber for supplying the bubble generation liquid to a plurality of second liquid flow paths.

In the case that the bubble generation liquid and ejection liquid are the same liquids, the number of the common liquid chambers may be one.

Between the first and second liquid flow paths, there is a separation wall 30 of an elastic material such as metal so that the first flow path and the second flow path are separated.

Figure 7:
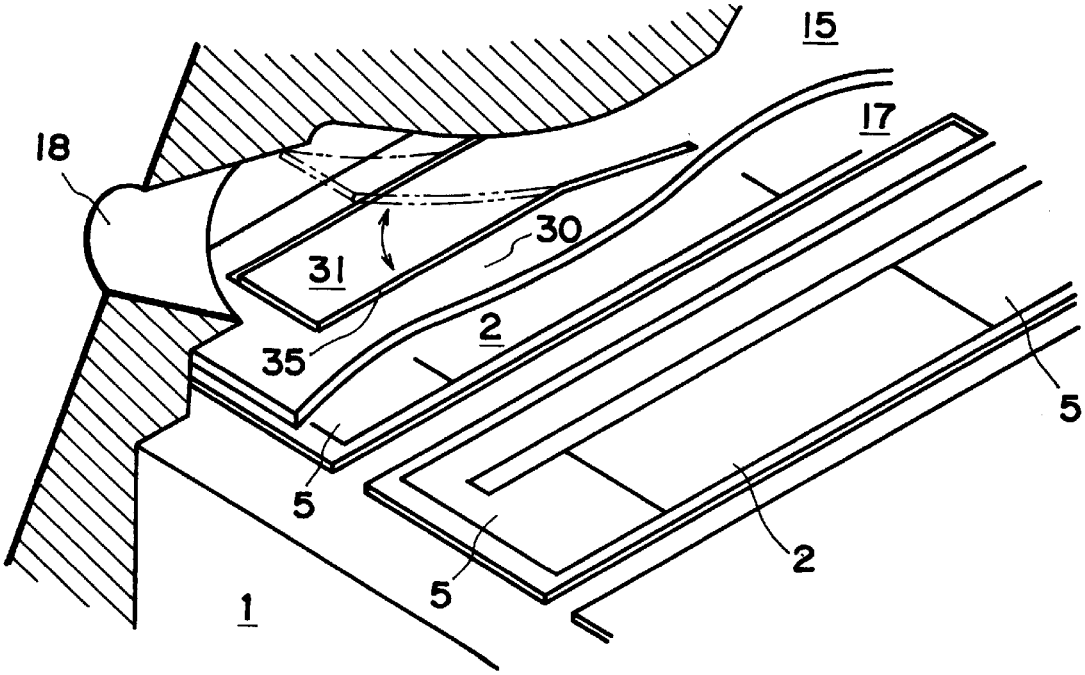
FIG. 7 is a partly broken perspective view of a liquid ejecting head according to a sixth embodiment of the present invention.

A portion of the partition wall in the upward projection space of the heat generating element (ejection pressure generation region including A and B (bubble generation region 11) in FIG. 6), is in the form of a cantilever movable member 31, formed by slits 35, having a fulcrum 33 at the common liquid chamber (15, 17) side and free end at the ejection outlet side (downstream with respect to the general flow of the liquid). The movable member 31 is faced to the surface, and therefore, it operates to open toward the ejection outlet side of the first liquid flow path upon the bubble generation of the bubble generation liquid (direction of the arrow in the Figure). In an example of FIG. 7, too, a partition wall 30 is disposed, with a space for constituting a second liquid flow path, above an element substrate 1 provided with a heat generating resistor portion as the heat generating element 2 and wiring electrodes 5 for applying an electric signal to the heat generating resistor portion.

As for the positional relation among the fulcrum 33 and the free end 32 of the movable member 31 and the heat generating element, they are the same as in the previous example.

In the previous example, the description has been made as to the relation between the structures of the liquid supply passage 12 and the heat generating element 2. the relation between the second liquid flow path 16 and the heat generating element 2 is the same in this embodiment.

Referring to FIG. 8, the operation of the liquid ejecting head of this embodiment will be described.

The used ejection liquid in the first liquid flow path 14 and the used bubble generation liquid in the second liquid flow path 16 were the same water base inks.

By the heat generated by the heat generating element 2, the bubble generation liquid in the bubble generation region in the second liquid flow path generates a bubble 40, by film boiling phenomenon as described hereinbefore.

In this embodiment, the bubble generation pressure is not released in the three directions except for the upstream side in the bubble generation region, so that the pressure produced by the bubble generation is propagated concentratedly on the movable member 6 side in the ejection pressure generation portion, by which the movable member 6 is displaced from the position indicated in FIG. 8(*a*) toward the first liquid flow path side as indicated in FIG. 8(*b*) with the growth of the bubble. By the operation of the movable member, the first liquid flow path 14 and the second liquid flow path 16 are in wide fluid communication with each other, and the pressure produced by the generation of the bubble is mainly propagated toward the ejection outlet in the first liquid flow path (direction A). By the propagation of the pressure and the mechanical displacement of the movable member, the liquid is ejected through the ejection outlet.

Then, with the contraction of the bubble, the movable member 31 returns to the position indicated in FIG. 8(*a*), and correspondingly, an amount of the liquid corresponding to the ejection liquid is supplied from the upstream in the first liquid flow path 14. In this embodiment, the direction of the liquid supply is codirectional with the closing of the movable member as in the foregoing embodiments, the refilling of the liquid is not impeded by the movable member.

The major functions and effects as regards the propagation of the bubble generation pressure with the displacement of the movable wall, the direction of the bubble growth, the prevention of the back wave and so on, in this embodiment, are the same as with the first embodiment, but the two-flow-path structure is advantageous in the following points.

The ejection liquid and the bubble generation liquid may be separated, and the ejection liquid is ejected by the pressure produced in the bubble generation liquid. Accordingly, a high viscosity liquid such as polyethylene glycol or the like with which bubble generation and therefore ejection force is not sufficient by heat application, and which has not been ejected in good order, can be ejected. for example, this liquid is supplied into the first liquid flow path, and liquid with which the bubble generation is in good order is supplied into the second path as the bubble generation liquid. An example of the bubble generation liquid is a mixture liquid (1–2 cP approx.) of the anol and water (4:6). By doing so, the ejection liquid can be properly ejected.

Additionally, by selecting as the bubble generation liquid a liquid with which the deposition such as kogation does not remain on the surface of the heat generating element even upon the heat application, the bubble generation is stabilized to assure the proper ejections. The above-described effects in the foregoing embodiments are also provided in this embodiment, the high viscous liquid or the like can be ejected with a high ejection efficiency and a high ejection pressure.

Furthermore, liquid which is not durable against heat is ejectable. In this case, such a liquid is supplied in the first liquid flow path as the ejection liquid, and a liquid which is not easily altered in the property by the heat and with which the bubble generation is in good order, is supplied in the second liquid flow path. By doing so, the liquid can be ejected without thermal damage and with high ejection efficiency and with high ejection pressure.

In the foregoing, the description has been made as to the major parts of the liquid ejecting head and the liquid ejecting method according to the embodiments of the present invention.

<Liquid flow path ceiling configuration>

FIG. 9 is a sectional view taken along the length of the flow path of the liquid ejecting head according to the embodiment. Grooves for constituting the first liquid flow paths 14 (or liquid flow paths 10 in FIG. 1) are formed in grooved member 50 on a partition wall 30. In this embodiment, the height of the flow path ceiling adjacent the free end 32 position of the movable member is greater to permit larger operation angle θ of the movable member. The operation range of the movable member is determined in consideration of the structure of the liquid flow path, the durability of the movable member and the bubble generation power or the like. It is desirable that it moves in the angle range wide enough to include the angle of the position of the ejection outlet.

As shown in this Figure, the displaced level of the free end of the movable member is made higher than the diameter of the ejection outlet, by which sufficient ejection pressure is transmitted. As shown in this Figure, a height of the liquid flow path ceiling at the fulcrum 33 position of the movable member is lower than that of the liquid flow path ceiling at the free end 32 position of the movable member, so that the release of the pressure wave to the upstream side due to the displacement of the movable member can be further effectively prevented.

<Positional relation between second liquid flow path and movable member>

Figures 10A, 10B, 10C:
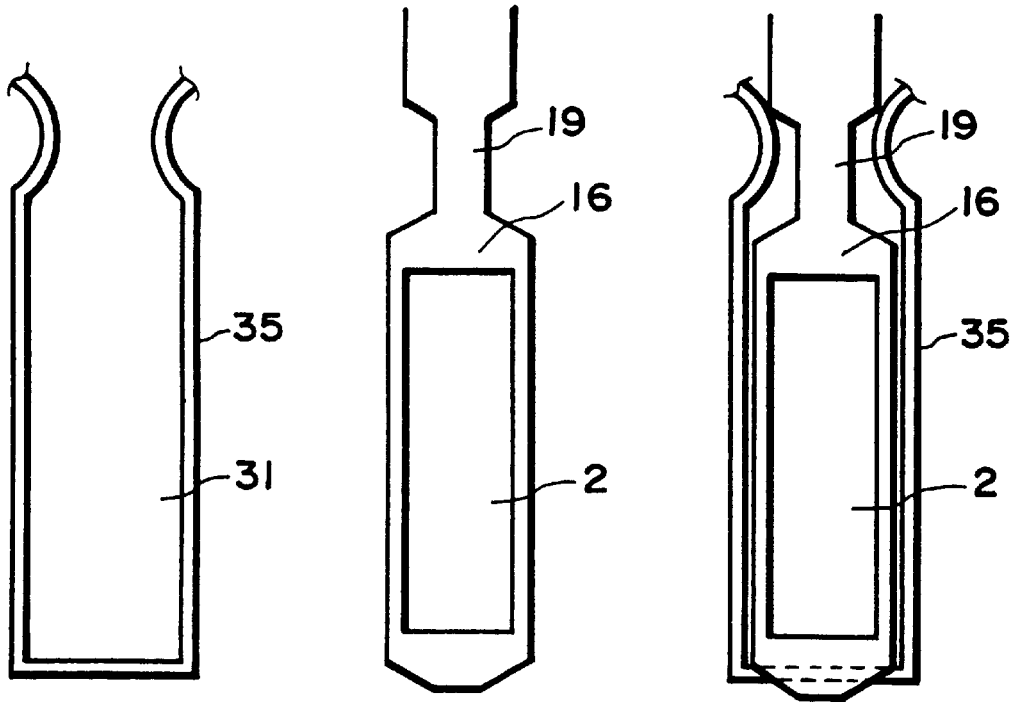
FIGS. 10(*a*)–10(*b*) are illustrations of a structure of a liquid flow path and a movable member.

FIG. 10 is an illustration of a positional relation between the above-described movable member 31 and second liquid flow path 16, and FIG. 10(*a*) is a view of the movable member 31 position of the partition wall 30 as seen from the above, and FIG. 10(*b*) is a view of the second liquid flow path 16 seen from the above without partition wall 30. FIG. 10(*c*) is a schematic view of the positional relation between the movable member 6 and the second liquid flow path 16 wherein the elements are overlaid. In these Figures, the bottom is a front side having the ejection outlets.

The second liquid flow path 16 of this embodiment has a throat portion 19 upstream of the heat generating element 2 with respect to a general flow of the liquid from the second common liquid chamber side to the ejection outlet through the heat generating element position, the movable member position along the first flow path, so as to provide a chamber (bubble generation chamber) effective to suppress easy release, toward the upstream side, of the pressure produced upon the bubble generation in the second liquid flow path 16.

As shown in FIG. 10(*c*), the lateral sides of the movable member 31 cover respective parts of the walls constituting the second liquid flow path so that the falling of the movable member 31 into the second liquid flow path is prevented. By doing so, the above-described separation between the ejection liquid and the bubble generation liquid is further enhanced. Furthermore, the release of the bubble through the slit can be suppressed so that ejection pressure and ejection efficiency are further increased. Moreover, the above-described effect of the refilling from the upstream side by the pressure upon the collapse of bubble, can be further enhanced.

In FIG. 8(*b*) and FIG. 9, a part of of the bubble generated in the bubble generation region of the second liquid flow path 4 with the displacement of the movable member 6 to the first liquid flow path 14 side, extends into the first liquid flow path 14 side. By selecting the height of the second flow path to permit such extension of the bubble, the ejection force is further improved as compared with the case without such extension of the bubble.

<Movable member and partition wall>

Figures 11A, 11B, 11C:
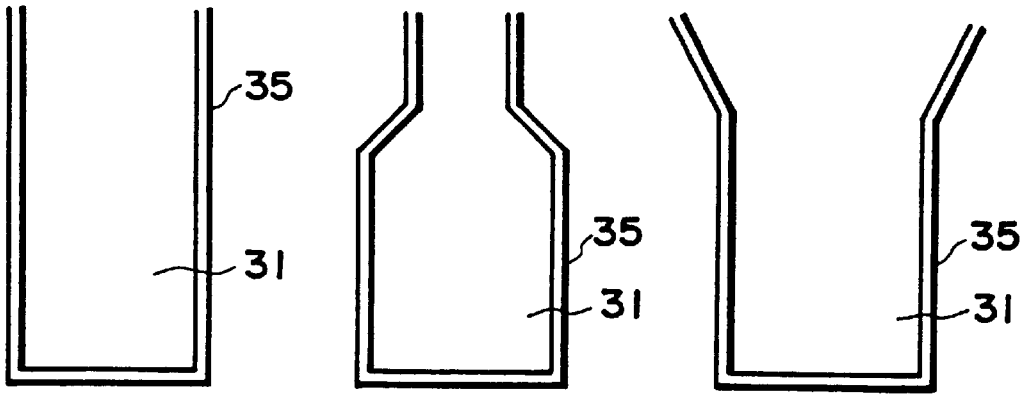
FIGS. 11(*a*)–11(*c*) are illustrations is an illustration of another configuration of the movable member.

FIG. 11 shows another example of the movable member 31, wherein reference numeral 35 designates a slit formed in the partition wall, and the slit is effective to provide the movable member 31. In FIG. 11(*a*), the movable member has a rectangular configuration, and in FIG. 11(*b*), it is narrower in the fulcrum side to permit increased mobility of the movable member, and in FIG. 11(*c*), it has a wider fulcrum side to enhance the durability of the movable member. The configuration narrowed and arcuated at the fulcrum side is desirable as shown in FIG. 5(*a*), since both of easiness of motion and durability are satisfied. However, the configuration of the movable member is not limited to the one described above, but it may be any if it does not enter the second liquid flow path side, and motion is easy with high durability.

In the foregoing embodiments, the plate or film movable member 31 and the separation wall 5 having this movable member was made of a nickel having a thickness of 5 μm, but this is not limited to this example, but it may be any if it has anti-solvent property against the bubble generation liquid and the ejection liquid, and if the elasticity is enough to permit the operation of the movable member, and if the required fine slit can be formed.

Preferable examples of the materials for the movable member include durable materials such as metal such as silver, nickel, gold, iron, titanium, aluminum, platinum, tantalum, stainless steel, phosphor bronze or the like, alloy thereof, or resin material having nytril group such as acrylonitrile, butadiene, stylene or the like, resin material having amide group such as polyamide or the like, resin material having carboxyl such as polycarbonate or the like, resin material having aldehyde group such as polyacetal or the like, resin material having sulfon group such as polysulfone, resin material such as liquid crystal polymer or the like, or chemical compound thereof; or materials having durability against the ink, such as metal such as gold, tungsten, tantalum, nickel, stainless steel, titanium, alloy thereof, materials coated with such metal, resin material having amide group such as polyamide, resin material having aldehyde group such as polyacetal, resin material having ketone group such as polyetheretherketone, resin material having imide group such as polyimide, resin material having hydroxyl group such as phenolic resin, resin material having ethyl group such as polyethylene, resin material having alkyl group such as polypropylene, resin material having epoxy group such as epoxy resin material, resin material having amino group such as melamine resin material, resin material having methylol group such as xylene resin material, chemical compound thereof, ceramic material such as silicon dioxide or chemical compound thereof.

Preferable examples of partition or division wall include resin material having high heat-resistive, high anti-solvent property and high molding property, more particularly recent engineering plastic resin materials such as polyethylene, polypropylene, polyamide, polyethylene terephthalate, melamine resin material, phenolic resin, epoxy resin material, polybutadiene, polyurethane, polyetheretherketone, polyether sulfone, polyallylate, polyimide, poly—sulfone, liquid crystal polymer (LCP), or chemical compound thereof, or metal such as silicon dioxide, silicon nitride, nickel, gold, stainless steel, alloy thereof, chemical compound thereof, or materials coated with titanium or gold.

The thickness of the separation wall is determined depending on the used material and configuration from the standpoint of sufficient strength as the wall and sufficient operativity as the movable member, and generally, 0.5 μm–10 μm approx. is desirable.

In this invention, the movable member has a thickness of μm order as preferable thickness, and a movable member having a thickness of μm order is not used in usual cases. When a slit is formed in the movable member having a thickness of μm order, and the slit has the width (W μm) of the order of the thickness of the movable member, it is desirable to consider the variations in the manufacturing.

The slit providing the "substantial sealing", preferably has several microns width, since the liquid mixture prevention is assured.

<Element substrate>

The description will be made as to a structure of the element substrate provided with the heat generating element for heating the liquid.

Figure 12A:
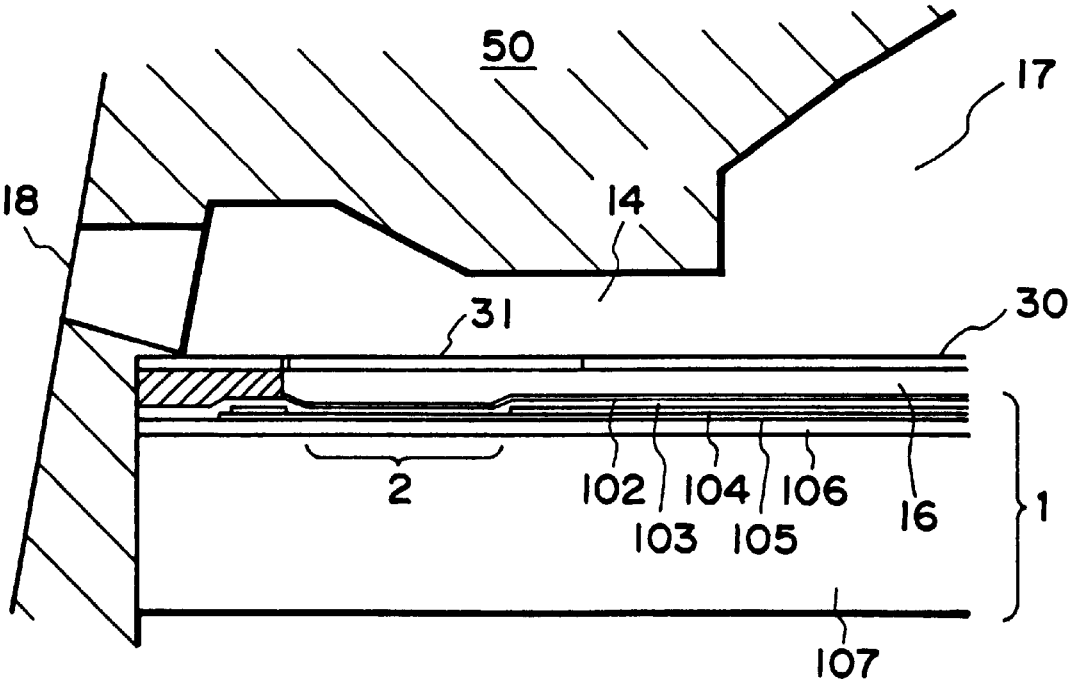
FIGS. 12(*a*)–12(*b*) are longitudinal sections of a liquid ejecting head according to an embodiment of the present invention.
Figure 12B:
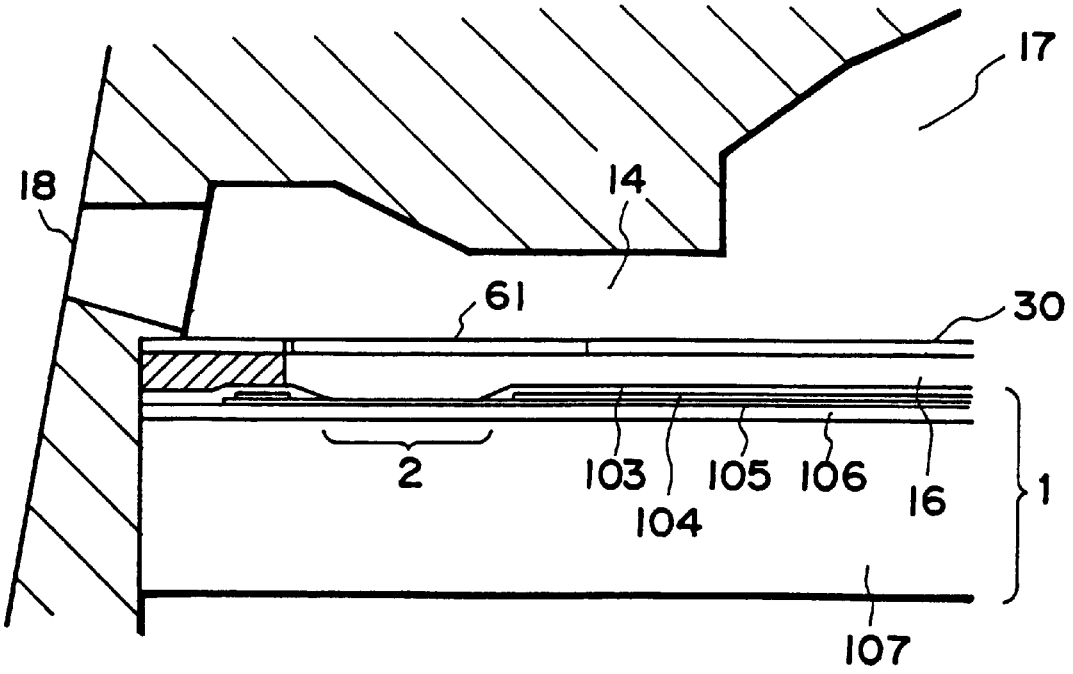

FIG. 12 is a longitudinal section of the liquid ejecting head according to an embodiment of the present invention. FIG. 12(*a*) shows the head having a protection layer, and FIG. 12(*b*) shows the one without the protection layer.

On the element substrate 1, a grooved member 50 is mounted, the member 50 having second liquid flow paths 16, separation walls 30, first liquid flow paths 14 and grooves for constituting the first liquid flow path.

The element substrate 1 has, as shown in FIG. 12, patterned wiring electrode (0.2–1.0 μm thick) of aluminum or the like and patterned electric resistance layer 105 (0.01–0.2 μm thick) of hafnium boride ($HfB_2$), tantalum nitride (TaN), tantalum aluminum (TaAl) or the like constituting the heat generating element on a silicon oxide film or silicon nitride film 106 for insulation and heat accumulation, which in turn is on the substrate 107 of silicon or the like. A voltage is applied to the resistance layer 105 through the two wiring electrodes 104 to flow a current through the resistance layer to effect heat generation. Between the wiring electrode, a protection layer of silicon oxide, silicon nitride or the like of 0.1–2.0 μm thick is provided on the resistance layer, and in addition, an anti-cavitation layer of tantalum or the like (0.1–0.6 μm thick) is formed thereon to protect the resistance layer 105 from various liquids such as ink.

The pressure and shock wave generated upon the bubble generation and collapse is so strong that the durability of the oxide film which is relatively fragile is deteriorated. Therefore, metal material such as tantalum (Ta) or the like is used as the anti-cavitation layer.

The protection layer may be omitted depending on the combination of liquid, liquid flow path structure and resistance material. One of such examples is shown in FIG. 12(*b*). The material of the resistance layer not requiring the protection layer, includes, for example, iridium—tantalum—aluminum alloy or the like. Thus, the structure of the heat generating element in the foregoing embodiments may include only the resistance layer (heat generation portion) or may include a protection layer for protecting the resistance layer.

In the embodiment, the heat generating element has a heat generation portion having the resistance layer which generates heat in response to the electric signal. This is not limiting, and it will suffice if a bubble enough to eject the ejection liquid is created in the bubble generation liquid. For example, heat generation portion may be in the form of a photothermal transducer which generates heat upon receiving light such as laser, or the one which generates heat upon receiving high frequency wave.

On the element substrate 1, function elements such as a transistor, a diode, a latch, a shift register and so on for selective driving the electrothermal transducer element may also be integrally built in, in addition to the resistance layer 105 constituting the heat generation portion and the electrothermal transducer constituted by the wiring electrode 104 for supplying the electric signal to the resistance layer.

Figure 13:
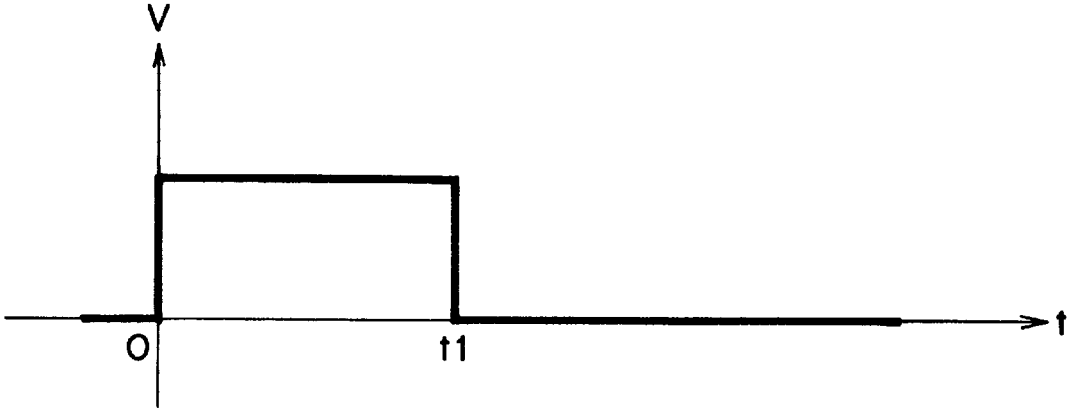
FIG. 13 is a schematic view of a configuration of a driving pulse.

In order to eject the liquid by driving the heat generation portion of the electrothermal transducer on the above-described element substrate 1, the resistance layer 105 is supplied through the wiring electrode 104 with rectangular pulses as shown in FIG. 13 to cause instantaneous heat generation in the resistance layer 105 between the wiring electrode. In the case of the heads of the foregoing embodiments, the applied energy has a voltage of 24V, a pulse width of 7 $\mu$sec, a current of 150 mA and a frequency of 6 kHz to drive the heat generating element, by which the liquid ink is ejected through the ejection outlet through the process described hereinbefore. However, the driving signal conditions are not limited to this, but may be any if the bubble generation liquid is properly capable of bubble generation.

<Head structure of 2 flow path structure>

The description will be made as to a structure of the liquid ejecting head with which different liquids are separately accommodated in first and second common liquid chambers, and the number of parts can be reduced so that the manufacturing cost can be reduced.

Figure 14:
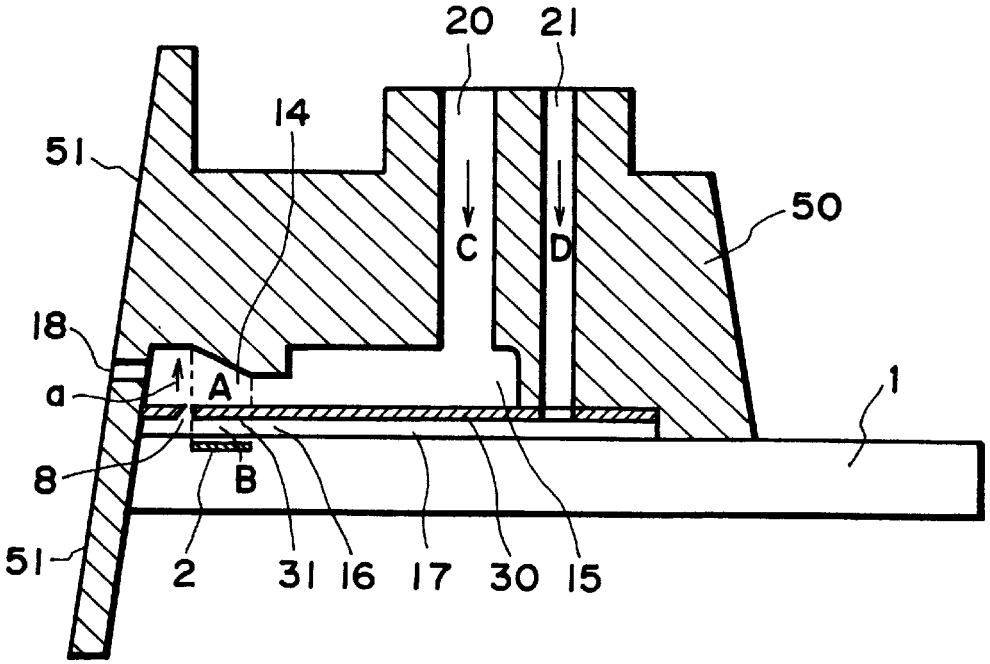
FIG. 14 is a sectional view of a supply passage of a liquid ejecting head in an embodiment of the present invention.

FIG. 14 is a schematic view of such a liquid ejecting head. The same reference numerals as in the previous embodiment are assigned to the elements having the corresponding functions, and detailed descriptions thereof are omitted for simplicity.

In this embodiment, a grooved member 50 has an orifice plate 51 having an ejection outlet 18, a plurality of grooves for constituting a plurality of first liquid flow paths 14 and a recess for constituting the first common liquid chamber 15 for supplying the liquid (ejection liquid) to the plurality of liquid flow paths 14. A separation wall 30 is mounted to the bottom of the grooved member 50 by which plurality of first liquid flow paths 14 are formed. Such a grooved member 50 has a first liquid supply passage 20 extending from an upper position to the first common liquid chamber 15. The grooved member 50 also has a second liquid supply passage 21 extending from an upper position to the second common liquid chamber 17 through the separation wall 30.

As indicated by an arrow C in FIG. 14, the first liquid (ejection liquid) is supplied through the first liquid supply passage 20 and first common liquid chamber 15 to the first liquid flow path 14, and the second liquid (bubble generation liquid) is supplied to the second liquid flow path 16 through the second liquid supply passage 21 and the second common liquid chamber 17 as indicated by arrow D in FIG. 14.

In this example, the second liquid supply passage 21 is extended in parallel with the first liquid supply passage 20, but this is not limited to the exemplification, but it may be any if the liquid is supplied to the second common liquid chamber 17 through the separation wall 30 outside the first common liquid chamber 15.

The diameter of the second liquid supply passage 21 is determined in consideration of the supply amount of the second liquid. The configuration of the second liquid supply passage 21 is not limited to circular or round but may be rectangular or the like.

Figure 15:
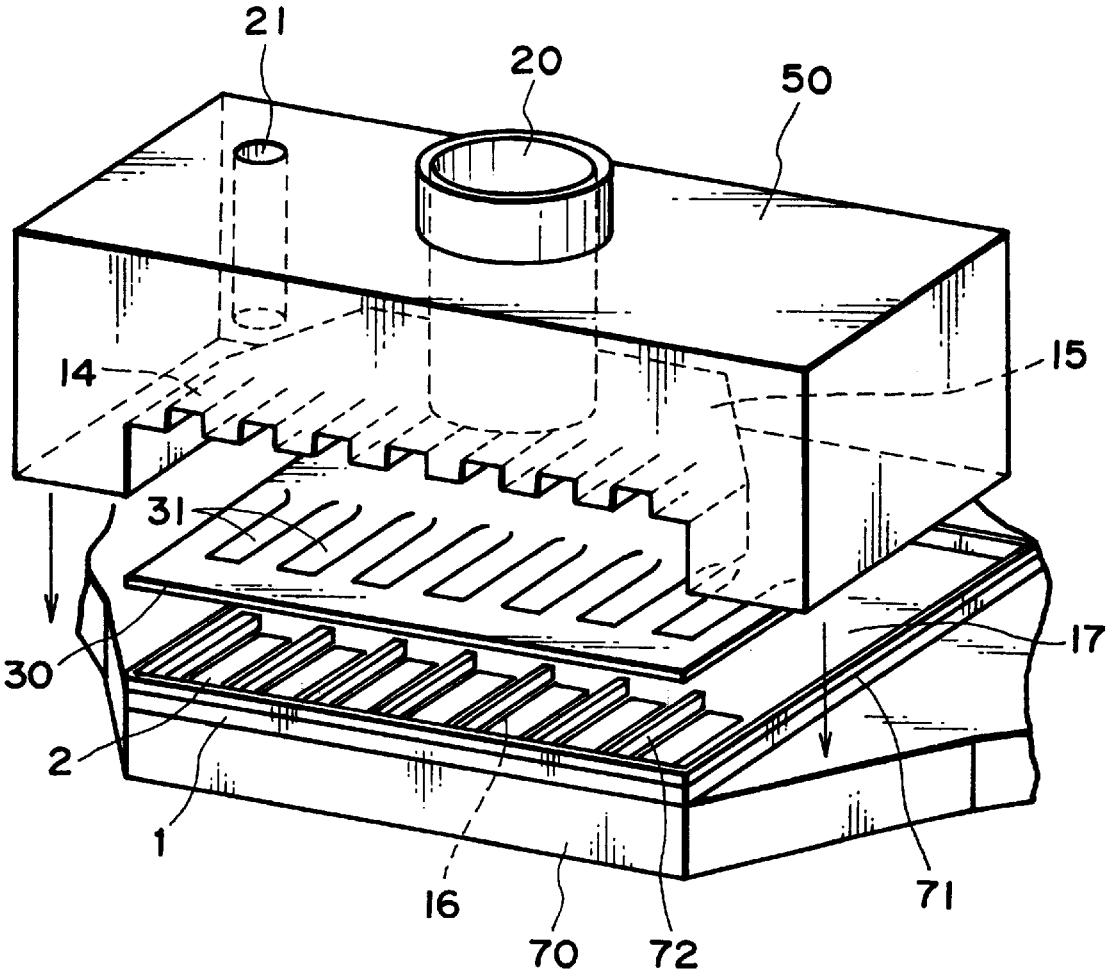
FIG. 15 is an exploded perspective view of a head of an embodiment of the present invention.
Figure 16A:
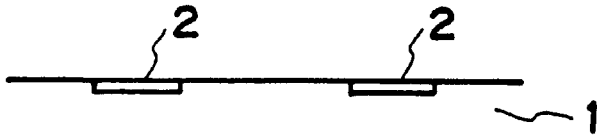
FIGS. 16(*a*)–16(*e*) comprise a process chart of manufacturing method of a liquid ejecting head in an embodiment of the present invention.
Figure 16B:
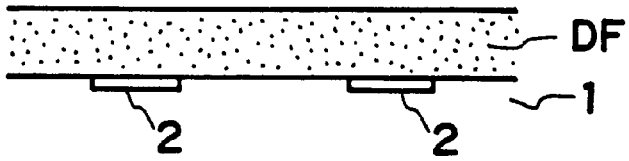
Figure 16C:
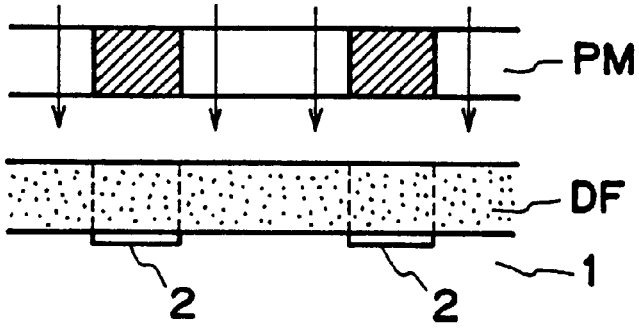
Figure 16D:
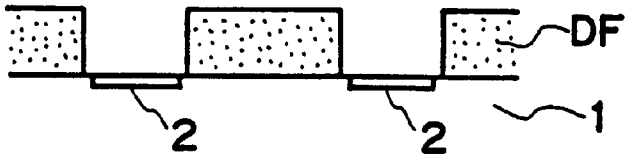
Figure 16E:
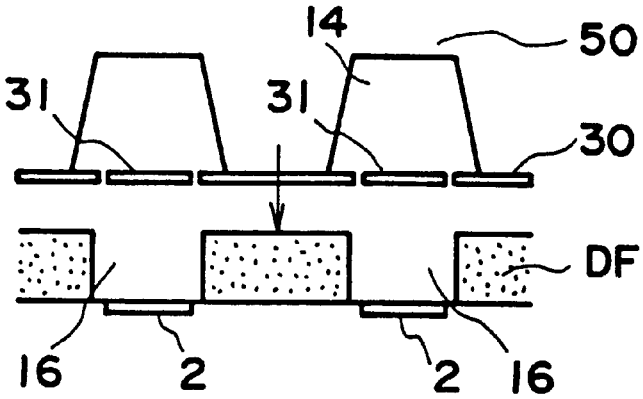
Figure 17A:
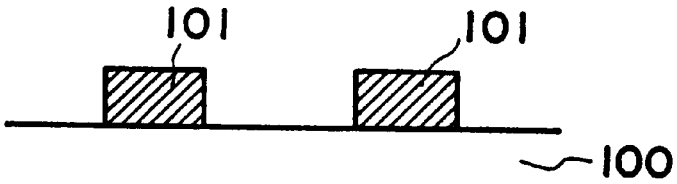
FIGS. 17(*a*)–17(*d*) comprise a process chart of a manufacturing method of a liquid ejecting head according to an embodiment of the present invention.
Figure 17B:
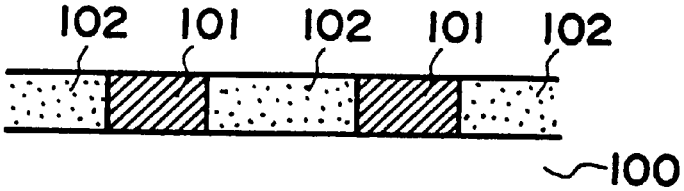
Figure 17C:
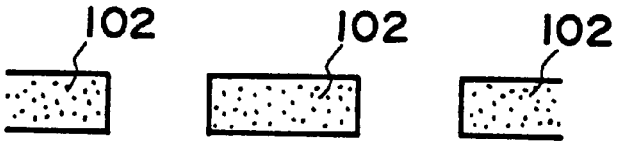
Figure 17D:
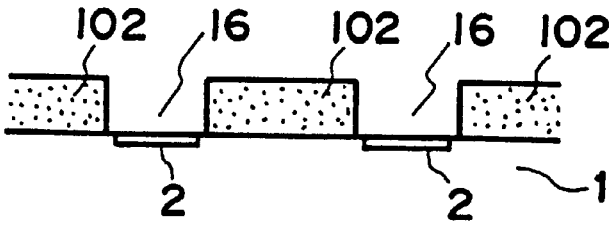
Figure 18A:
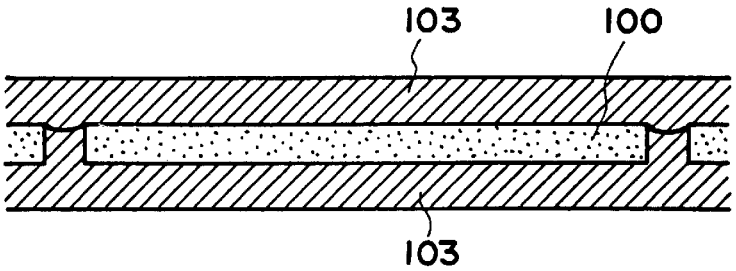
Figure 18B:
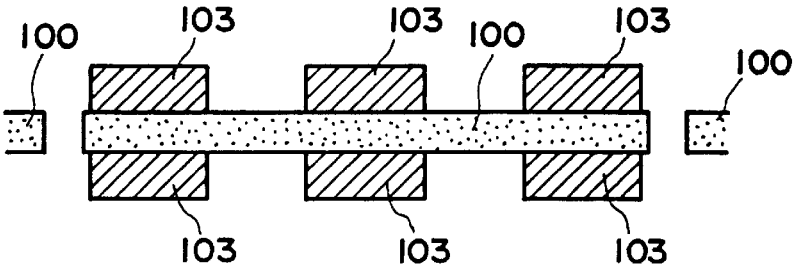
Figure 18C:
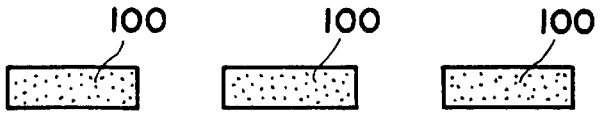
Figure 18D:
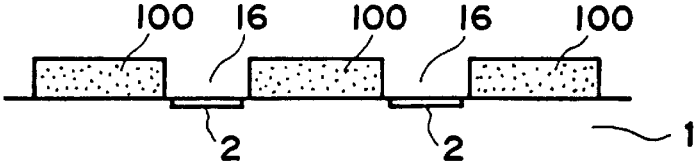

The second common liquid chamber 17 may be formed by dividing the grooved member by a separation wall 30. As for the method of forming this, as shown in FIG. 15 which is an exploded perspective view, a common liquid chamber frame and a second liquid passage wall are formed of a dry film, and a combination of a grooved member 50 having the separation wall fixed thereto and the element substrate 1 are bonded, thus forming the second common liquid chamber 17 and the second liquid flow path 16.

In this example, the element substrate 1 is constituted by providing the supporting member 70 of metal such as aluminum with a plurality of electrothermal transducer elements as heat generating elements for generating heat for bubble generation from the bubble generation liquid through film boiling.

Above the element substrate 1, there are disposed the plurality of grooves constituting the liquid flow path 16 formed by the second liquid passage walls, the recess for constituting the second common liquid chamber (common bubble generation liquid chamber) 17 which is in fluid communication with the plurality of bubble generation liquid flow paths for supplying the bubble generation liquid to the bubble generation liquid passages, and the separation or dividing walls 30 having the movable walls 31.

Designated by reference numeral 50 is a grooved member. The grooved member is provided with grooves for constituting the ejection liquid flow paths (first liquid flow paths) 14 by mounting the separation walls 30 thereto, a recess for constituting the first common liquid chamber (common ejection liquid chamber) 15 for supplying the ejection liquid to the ejection liquid flow paths, the first supply passage (ejection liquid supply passage) 20 for supplying the ejection liquid to the first common liquid chamber, and the second supply passage (bubble generation liquid supply passage) 21 for supplying the bubble generation liquid to the second supply passage (bubble generation liquid supply passage) 21. The second supply passage 21 is connected with a fluid communication path in fluid communication with the second common liquid chamber 17, penetrating through the separation wall 30 disposed outside of the first common liquid chamber 15. By the provision of the fluid communication path, the bubble generation liquid can be supplied to the second common liquid chamber 15 without mixture with the ejection liquid.

The positional relation among the element substrate 1, separation wall 30, grooved top plate 50 is such that the movable members 31 are arranged corresponding to the heat generating elements on the element substrate 1, and that the ejection liquid flow paths 14 are arranged corresponding to the movable members 31. In this example, one second supply passage is provided for the grooved member, but it may be plural in accordance with the supply amount. The cross-sectional area of the flow path of the ejection liquid supply passage 20 and the bubble generation liquid supply passage 21 may be determined in proportion to the supply amount. By the optimization of the cross-sectional area of the flow path, the parts constituting the grooved member 50 or the like can be downsized.

As described in the foregoing, according to this embodiment, the second supply passage for supplying the second liquid to the second liquid flow path and the first supply passage for supplying the first liquid to the first liquid flow path, can be provided by a single grooved top plate, so that the number of parts can be reduced, and therefore, the reduction of the manufacturing steps and therefore the reduction of the manufacturing cost, are accomplished.

Furthermore, the supply of the second liquid to the second common liquid chamber in fluid communication with the second liquid flow path, is effected through the second liquid flow path which penetrates the separation wall for separating the first liquid and the second liquid, and therefore, one bonding step is enough for the bonding of the separation wall, the grooved member and the heat generating element substrate, so that the manufacturing is easy, and the accuracy of the bonding is improved.

Since the second liquid is supplied to the second liquid common liquid chamber, penetrating the separation wall, the supply of the second liquid to the second liquid flow path is assured, and therefore, the supply amount is sufficient so that the stabilized ejection is accomplished.

<Ejection liquid and bubble generation liquid>

As described in the foregoing embodiment, according to the present invention, by the structure having the movable member described above, the liquid can be ejected at higher ejection force or ejection efficiency than the conventional liquid ejecting head. When the same liquid is used for the bubble generation liquid and the ejection liquid, it is possible that the liquid is not deteriorated, and that deposition on the heat generating element due to heating can be reduced. Therefore, a reversible state change is accomplished by repeating the gassification and condensation. So, various liquids are usable, if the liquid is the one not deteriorating the liquid flow passage, movable member or separation wall or the like.

Among such liquids, the one having the ingredient as used in conventional bubble jet device, can be used as a recording liquid.

When the two-flow-path structure of the present invention is used with different ejection liquid and bubble generation liquid, the bubble generation liquid having the above-described property is used, more particularly, the examples includes: methanol, ethanol, n-propyl alcohol, isopropyl alcohol, n- n-hexane, n-heptane, n-octane, toluene, xylene, methylene dichloride, trichloroethylene, Freon TF, Freon BF, ethyl ether, dioxane, cyclohexane, methyl acetate, ethyl acetate, acetone, methyl ethyl ketone, water, or the like, and a mixture thereof.

As for the ejection liquid, various liquids are usable without paying attention to the degree of bubble generation property or thermal property. The liquids which have not been conventionally usable, because of low bubble generation property and/or easiness of property change due to heat, are usable.

However, it is desired that the ejection liquid by itself or by reaction with the bubble generation liquid, does not impede the ejection, the bubble generation or the operation of the movable member or the like.

As for the recording ejection liquid, high viscous ink or the like is usable. As for another ejection liquid, pharmaceuticals and perfume or the like having a nature easily deteriorated by heat is usable.

<Manufacturing of liquid ejecting head>

The description will be made as to the manufacturing step of the liquid ejecting head according to the present invention.

In the case of the liquid ejecting head as shown in FIG. 1, a foundation 34 for mounting the movable member 31 is patterned and formed on the element substrate 1, and the movable member 31 is bonded or welded on the foundation 34. Then, a grooved member having a plurality of grooves for constituting the liquid flow paths 10, ejection outlet 18 and a recess for constituting the common liquid chamber 13, is mounted to the element substrate 1 with the grooves and movable members aligned with each other.

The description will be made as to a manufacturing step for the liquid ejecting head having the two-flow-path structure as shown in FIG. 6 and FIG. 15.

Generally, walls for the second liquid flow paths 16 are formed on the element substrate 1, and separation walls 30 are mounted thereon, and then, a. grooved member 50 having the grooves for constituting the first liquid flow paths 14, is mounted further thereon. Or, the walls for the second liquid flow paths 16 are formed, and a grooved member 50 having the separation walls 30 is mounted thereon.

The description will be made as to the manufacturing method for the second liquid flow path.

FIGS. 16(*a*)–(*e*) are schematic sectional view for illustrating a manufacturing method for the liquid ejecting head according to a first manufacturing embodiment of the present invention.

In this embodiment, as shown in FIG. 16(*a*), elements for electrothermal conversion having heat generating elements 2 of hafnium boride, tantalum nitride or the like, are formed, using a manufacturing device as in a semiconductor manufacturing, on an element substrate (silicon wafer) 1, and thereafter, the surface of the element substrate 1 is cleaned for the purpose of improving the adhesiveness or contactness with the photosensitive resin material in the next step. In order to further improve the adhesiveness or contactness, the surface of the element substrate is treated with ultraviolet-radiation-ozone or the like. Then, liquid comprising a silane coupling agent, for example, (A189, available from NIPPON UNICA) diluted by ethyl alcoholic to 1 weight % is applied on the improved surface by spin coating.

Subsequently, the surface is cleaned, and as shown in FIG. 16(*b*), an ultraviolet radiation photosensitive resin film (dry film Ordyl SY-318 available from Tokyo Ohka Kogyo Co., Ltd.) DF is laminated on the substratel having the thus improved surface.

Then, as shown in FIG. 16(*c*), a photo-mask PM is placed on the dry film DF, and the portions of the dry film DF which are to remain as the second flow passage wall is illuminated with the ultraviolet radiation through the photo-mask PM. The exposure process was carried out using MPA-600, available from, CANON KABUSHIKI KAISHA), and the exposure amount was approx. 600 mJ/cm$^2$.

Then, as shown in FIG. 16(*d*), the dry film DF was developed by developing liquid which is a mixed liquid of xylene and butyl Cellosolve acetate (BMRC-3 available from Tokyo Ohka Kogyo Co., Ltd.) to dissolve the unexposed portions, while leaving the exposed and cured portions as the walls for the second liquid flow paths 16. Furthermore, the residuals remaining on the surface of the element substrate 1 is removed by oxygen plasma ashing device (MAS-800 available from Alcan-Tech Co., Inc.) for approx. 90 sec, and it is exposed to ultraviolet radiation for 2 hours at 150° C. with the dose of 100 mJ/$cm_2$ to completely cure the exposed portions.

By this method, the second liquid flow paths can be formed with high accuracy on a plurality of heater boards (element substrates) cut out of the silicon substrate. The silicon substrate is cut into respective heater boards 1 by a dicing machine having a diamond blade of a thickness of 0.05 mm (AWD-4000 available from Tokyo Seimitsu). The separated heater boards 1 are fixed on the aluminum base plate 70 by adhesive material (SE4400 available from Toray), FIG. 19. Then, the printed board 71 connected to the aluminum base plate 70 beforehand is connected with the heater board 1 by aluminum wire (not shown) having a diameter of 0.05 mm.

As shown in FIG. 16(*e*), a joining member of the grooved member 50 and separation wall 30 were positioned and connected to the heater board 1. More particularly, grooved member having the separation wall 30 and the heater board 1 are positioned, and are engaged and fixed by a confining spring. Thereafter, the ink and bubble generation liquid supply member 80 is fixed on the ink. Then, the gap among the aluminum wire, grooved member 50, the heater board 1 and the ink and bubble generation liquid supply member 80 are sealed by a silicone sealant (TSE399, available from Toshiba silicone).

By forming the second liquid flow path through the manufacturing method, accurate flow paths without positional deviation relative to the heaters of the heater board, can be provided. By coupling the grooved member 50 and the separation wall 30 in the prior step, the positional accuracy between the first liquid flow path 14 and the movable member 31 is enhanced.

By the high accuracy manufacturing technique, the ejection stabilization is accomplished, and the printing quality is improved. Since they are formed all together on a wafer, mass production at low cost is possible.

In this embodiment, the use is made with an ultraviolet radiation curing type dry film for the formation of the second liquid flow path. But, a resin material having an absorption band adjacent particularly 248 nm (outside the ultraviolet range) may be laminated. it is cured, and such portions going to be the second liquid flow paths are directly removed by eximer laser.

FIGS. 17(*a*)–(*d*) are schematic sectional views for illustration of a manufacturing method of the liquid ejecting head according to a second embodiment of the present invention.

In this embodiment, as shown in FIG. 17(*a*), a resist 101 having a thickness of 15 μm is patterned in the shape of the second liquid flow path on the SUS substrate 100.

Then, as shown in FIG. 17(*b*), the SUS substrate 20 is coated with 15 μm thick of nickel layer 102 on the SUS substrate 100 by electroplating. The plating solution used comprised nickel amidosulfate nickel, stress decrease material (zero ohru, available from World Metal Inc.), boric acid, pit prevention material (NP-APS, available from World Metal Inc.) and nickel chloride. As to the electric field upon electro-deposition, an electrode is connected on the anode side, and the SUS substrate 100 already patterned is connected to the cathode, and the temperature of the plating solution is 50° C., and the current temperature is 5 A/$cm^2$.

Then, as shown in FIG. 17(*c*), the SUS substrate 100 having been subjected to the plating is subjected then to ultrasonic vibration to remove the nickel layer 102 portions from the SUS substrate 100 to provide the second liquid flow path.

On the other hand, the heater board having the elements for the electrothermal conversion, are formed on a silicon wafer by a manufacturing device as used in semiconductor manufacturing. The wafer is cut into heater boards by the dicing machine similarly to the foregoing embodiment. The heater board 1 is mounted to the aluminum base plate 70 already having a printed board 104 mounted thereto, and the printed board 7 and the aluminum wire (not shown) are connected to establish the electrical wiring. On such a heater board 1, the second liquid flow path provided through the foregoing process is fixed, as shown in FIG. 17(*d*). For this fixing, it may not be so firm if a positional deviation does not occur upon the top plate joining, since the fixing is accomplished by a confining spring with the top plate having the separation wall fixed thereto in the later step, as in the first embodiment.

In this embodiment, for the positioning and fixing, the use was made with an ultraviolet radiation curing type adhesive material (Amicon UV-300, available from GRACE JAPAN, and with an ultraviolet radiation projecting device operated with the exposure amount of 100 mJ/$cm^2$ for approx. 3 sec to complete the fixing.

According to the manufacturing method of this embodiment, the second liquid flow paths can be provided without positional deviation relative to the heat generating elements, and since the flow passage walls are of nickel, it is durable against the alkali property liquid so that the reliability is high.

FIGS. 18(*a*)–(*d*) are schematic sectional views for illustrating a manufacturing method of the liquid ejecting head according to a third embodiment of the present invention.

In this embodiment, as shown in FIG. 18(*a*), the resist 31 is applied on both of the sides of the SUS substrate 100 having a thickness of 15 μm and having an alignment hole or mark 100*a*. The resist used was PMERP-AR900 available from Tokyo Ohka Kogyo Co., Ltd.

Thereafter, as shown in FIG. 18(*b*), the exposure operation was carried out in alignment with the alignment hole 100*a* of the element substrate 100, using an exposure device (MPA-600 available from CANON KABUSHIKI KAISHA, JAPAN) to remove the portions of the resist 103 which are going to be the second liquid flow path. The exposure amount was 800 mJ/$cm^2$.

Subsequently, as shown in FIG. 18(*c*), the SUS substrate 100 having the patterned resist 103 on both sides, is dipped in etching liquid (aqueous solution of ferric chloride or cuprous chloride) to etch the portions exposed through the resist 103, and the resist is removed.

Then, as shown in FIG. 18(*d*), similarly to the foregoing embodiment of the manufacturing method, the SUS substrate 100 having been subjected to the etching is positioned and fixed on the heater board 1, thus assembling the liquid ejecting head having the second liquid flow paths 4.

According to the manufacturing method of this embodiment, the second liquid flow paths 4 without the positional deviation relative to the heaters can be provided, and since the flow paths are of SUS, the durability against acid and alkali liquid is high, so that high reliability liquid ejecting head is provided.

As described in the foregoing, according to the manufacturing method of this embodiment, by mounting the walls of the second liquid flow path on the element substrate in a prior step, the electrothermal transducers and second liquid flow paths are aligned with each other with high precision. Since a number of second liquid flow paths are formed simultaneously on the substrate before the cutting, mass production is possible at low cost.

The liquid ejecting head provided through the manufacturing method of this embodiment has the advantage that the second liquid flow paths and the heat generating elements are aligned at high precision, and therefore, the pressure of the bubble generation can be received with high efficiency so that the ejection efficiency is excellent.

<Liquid ejection head cartridge>

The description will be made as to a liquid ejection head cartridge having a liquid ejecting head according to an embodiment of the present invention.

Figure 19:
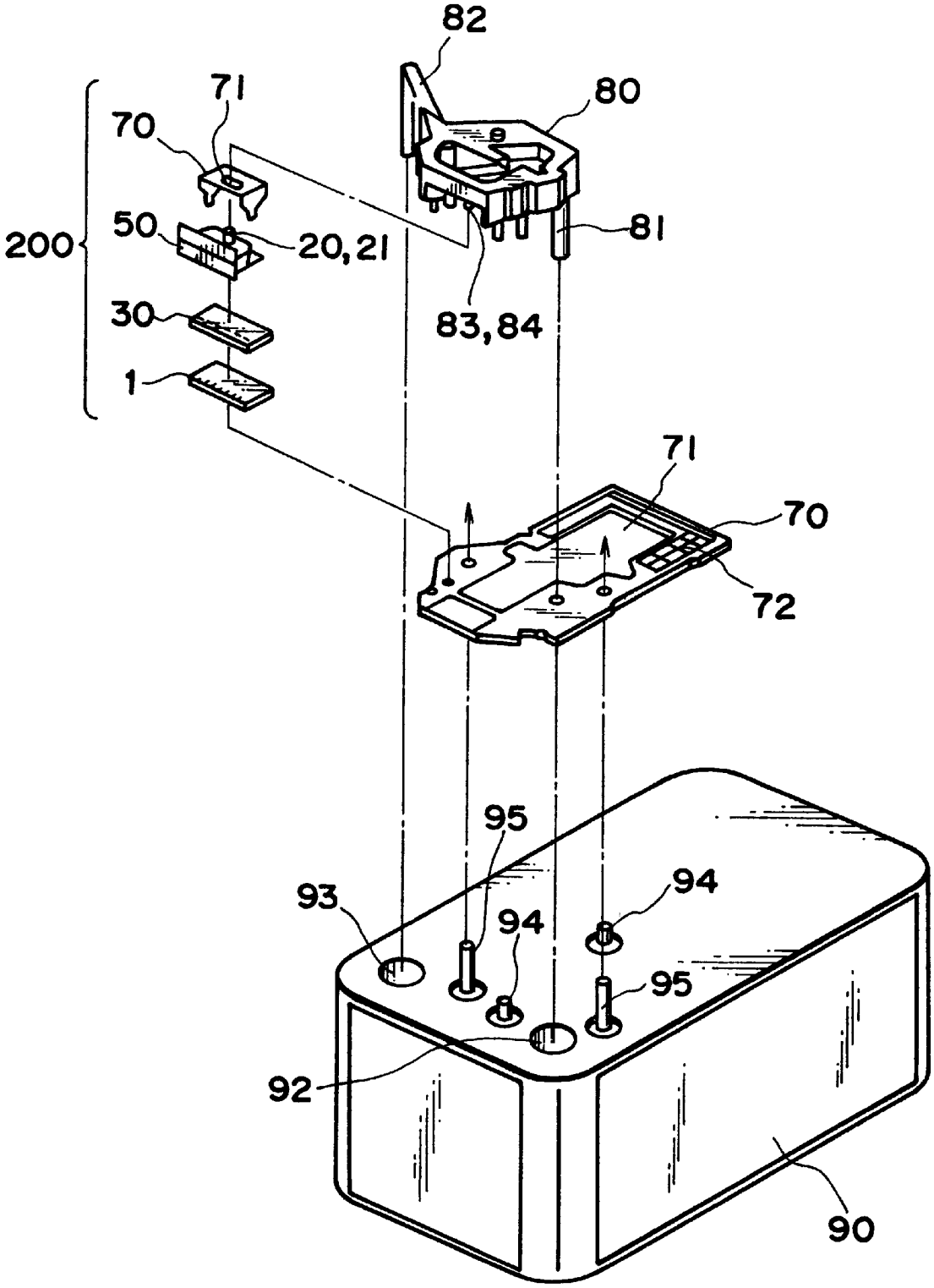
FIG. 19 is an exploded perspective view of a liquid ejection head cartridge.

FIG. 19 is a schematic exploded perspective view of a liquid ejection head cartridge including the above-described liquid ejecting head, and the liquid ejection head cartridge comprises generally a liquid ejecting head portion 200 and a liquid container 80.

The liquid ejecting head portion 200 comprises an element substrate 1, a separation wall 30, a grooved member 50, a confining spring 70, liquid supply member 90 and a supporting member 70. The element substrate 1 is provided with a plurality of heat generating resistors for supplying heat to the bubble generation liquid, as described hereinbefore. A bubble generation liquid passage is formed between the element substrate 1 and the separation wall 30 having the movable wall. By the coupling between the separation wall 30 and the grooved top plate 50, an ejection flow path (unshown) for fluid communication with the ejection liquid is formed.

The confining spring 70 functions to urge the grooved member 50 to the element substrate 1, and is effective to properly integrate the element substrate 1, separation wall 30, grooved and the supporting member 70 which will be described hereinafter.

Supporting member 70 functions to support an element substrate 1 or the like, and the supporting member 70 has thereon a circuit board 71, connected to the element substrate 1, for supplying the electric signal thereto, and contact pads 72 for electric signal transfer between the device side when the cartridge is mounted on the apparatus.

The liquid container 90 contains the ejection liquid such as ink to be supplied to the liquid ejecting head and the bubble generation liquid for bubble generation, separately. The outside of the liquid container 90 is provided with a positioning portion 94 for mounting a connecting member for connecting the liquid ejecting head with the liquid container and a fixed shaft 95 for fixing the connection portion. The ejection liquid is supplied to the ejection liquid supply passage 81 of a liquid supply member 80 through a supply passage 81 of the connecting member from the ejection liquid supply passage 92 of the liquid container, and is supplied to a first common liquid chamber through the ejection liquid supply passage 83, supply and 21 of the members. The bubble generation liquid is similarly supplied to the bubble generation liquid supply passage 82 of the liquid supply member 80 through the supply passage of the connecting member from the supply passage 93 of the liquid container, and is supplied to the second liquid chamber through the bubble generation liquid supply passage 84, 71, 20 of the members.

In such a liquid ejection head cartridge, even if the bubble generation liquid and the ejection liquid are different liquids, the liquids are supplied in good order. In the case that the ejection liquid and the bubble generation liquid are the same, the supply path for the bubble generation liquid and the ejection liquid are not necessarily separated.

After the liquid is used up, the liquid containers may be supplied with the respective liquids. To facilitate this supply, the liquid container is desirably provided with a liquid injection port. The liquid ejecting head and liquid container may be unseparably integral, or may be separable.

<Liquid ejecting device>

Figure 20:
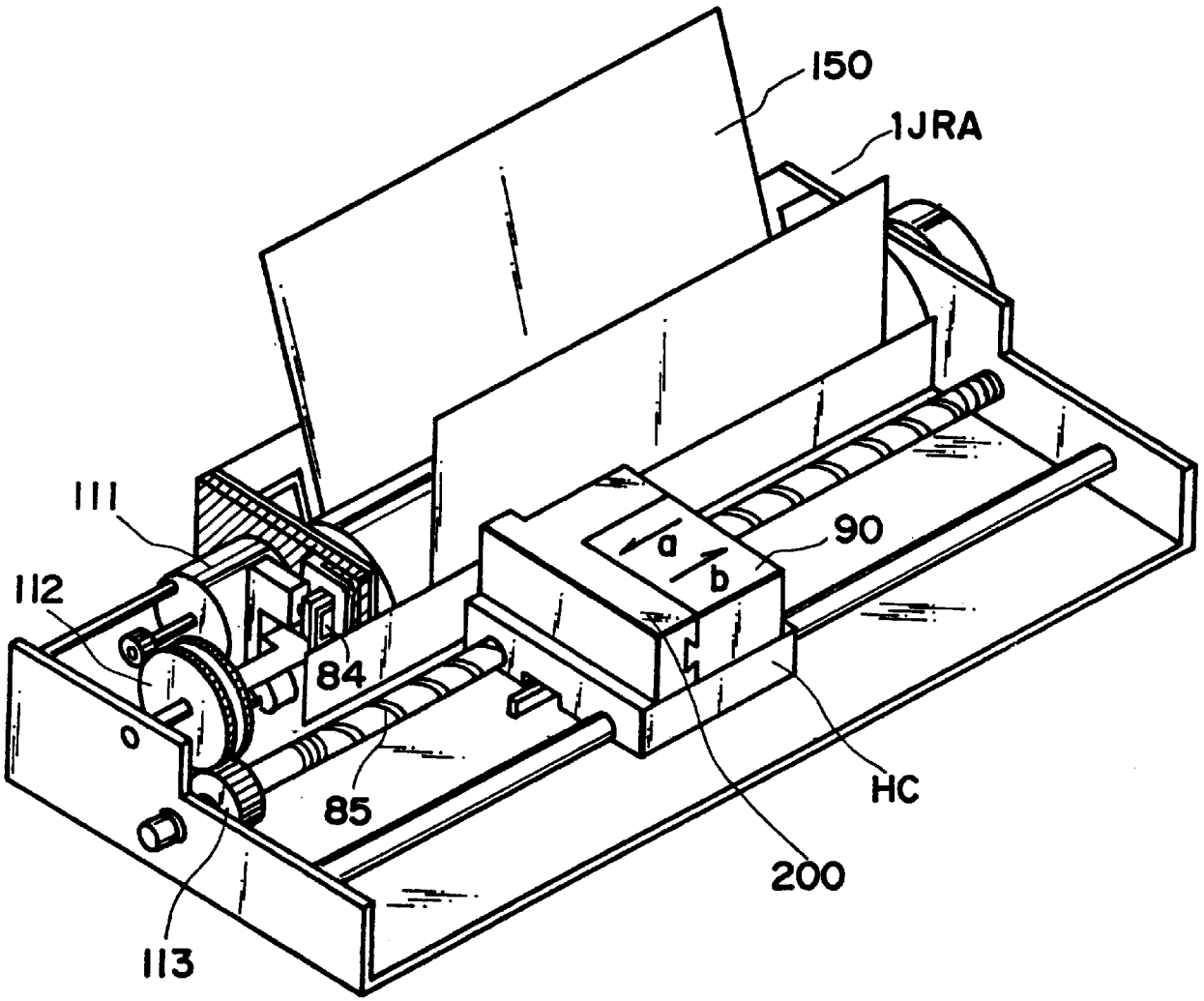
FIG. 20 is a schematic illustration of a liquid ejecting device.

FIG. 20 is a schematic illustration of a liquid ejecting device used with the above-described liquid ejecting head. In this embodiment, the ejection liquid is ink, and the apparatus is an ink ejection recording apparatus. The liquid ejecting device comprises a carriage HC to which the head cartridge comprising a liquid container portion 90 and liquid ejecting head portion 200 which are detachably connectable with each other, is mountable. The carriage HC is reciprocable in a direction of width of the recording material 150 such as a recording sheet or the like fed by a recording material transporting means.

When a driving signal is supplied to the liquid ejecting means on the carriage from unshown, driving signal supply means, the recording liquid is ejected to the recording material from the liquid ejecting head in response to the signal.

The liquid ejecting apparatus of this embodiment comprises a motor 111 as a driving source for driving the recording material transporting means and the carriage, gears 112, 113 for transmitting the power from the driving source to the carriage, and carriage shaft 115 and so on. By the recording device and the liquid ejecting method using this recording device, good prints can be provided by ejecting the liquid to the various recording material.

Figure 21:
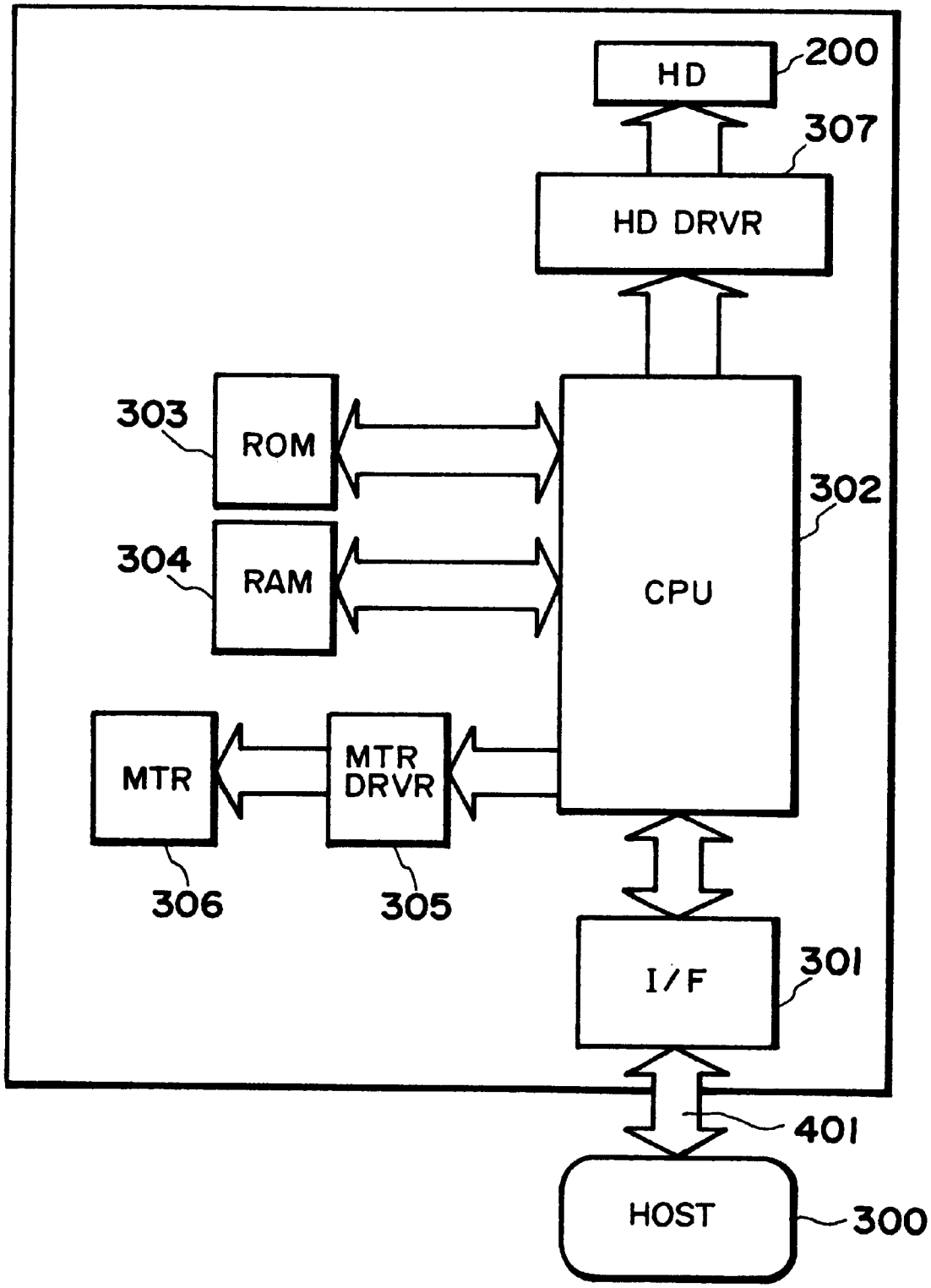
FIG. 21 is a block diagram of an apparatus.

FIG. 21 is a block diagram for describing the general operation of an ink ejection recording apparatus which employs the liquid ejection method, and the liquid ejection head, in accordance with the present invention.

The recording apparatus receives printing data in the form of a control signal from a host computer 300. The printing data is temporarily stored in an input interface 301 of the printing apparatus, and at the same time, is converted into processable data to be inputted to a CPU 302, which doubles as means for supplying a head driving signal. The CPU 302 processes the aforementioned data inputted to the CPU 302, into printable data (image data), by processing them with the use of peripheral units such as RAMs 304 or the like, following control programs stored in an ROM 303.

Further, in order to record the image data onto an appropriate spot on a recording sheet, the CPU 302 generates driving data for driving a driving motor which moves the recording sheet and the recording head in synchronism with the image data. The image data and the motor driving data are transmitted to a head 200 and a driving motor 306 through a head driver 307 and a motor driver 305, respectively, which are controlled with the proper timings for forming an image.

As for recording medium, to which liquid such as ink is adhered, and which is usable with a recording apparatus such as the one described above, the following can be listed: various sheets of paper; OHP sheets; plastic material used for forming compact disks, ornamental plates, or the like; fabric; metallic material such as aluminum, copper, or the like; leather material such as cow hide, pig hide, synthetic leather, or the like; lumber material such as solid wood, plywood, and the like; bamboo material; ceramic material such as tile; and material such as sponge which has a three dimensional structure.

The aforementioned recording apparatus includes a printing apparatus for various sheets of paper or OHP sheet, a recording apparatus for plastic material such as plastic material used for forming a compact disk or the like, a recording apparatus for metallic plate or the like, a recording apparatus for leather material, a recording apparatus for lumber, a recording apparatus for ceramic material, a recording apparatus for three dimensional recording medium such as sponge or the like, a textile printing apparatus for recording images on fabric, and the like recording apparatuses.

As for the liquid to be used with these liquid ejection apparatuses, any liquid is usable as long as it is compatible with the employed recording medium, and the recording conditions.

<Recording System>

Next, an exemplary ink jet recording system will be described, which records images on recording medium, using, as the recording head, the liquid ejection head in accordance with the present invention.

Figure 22:
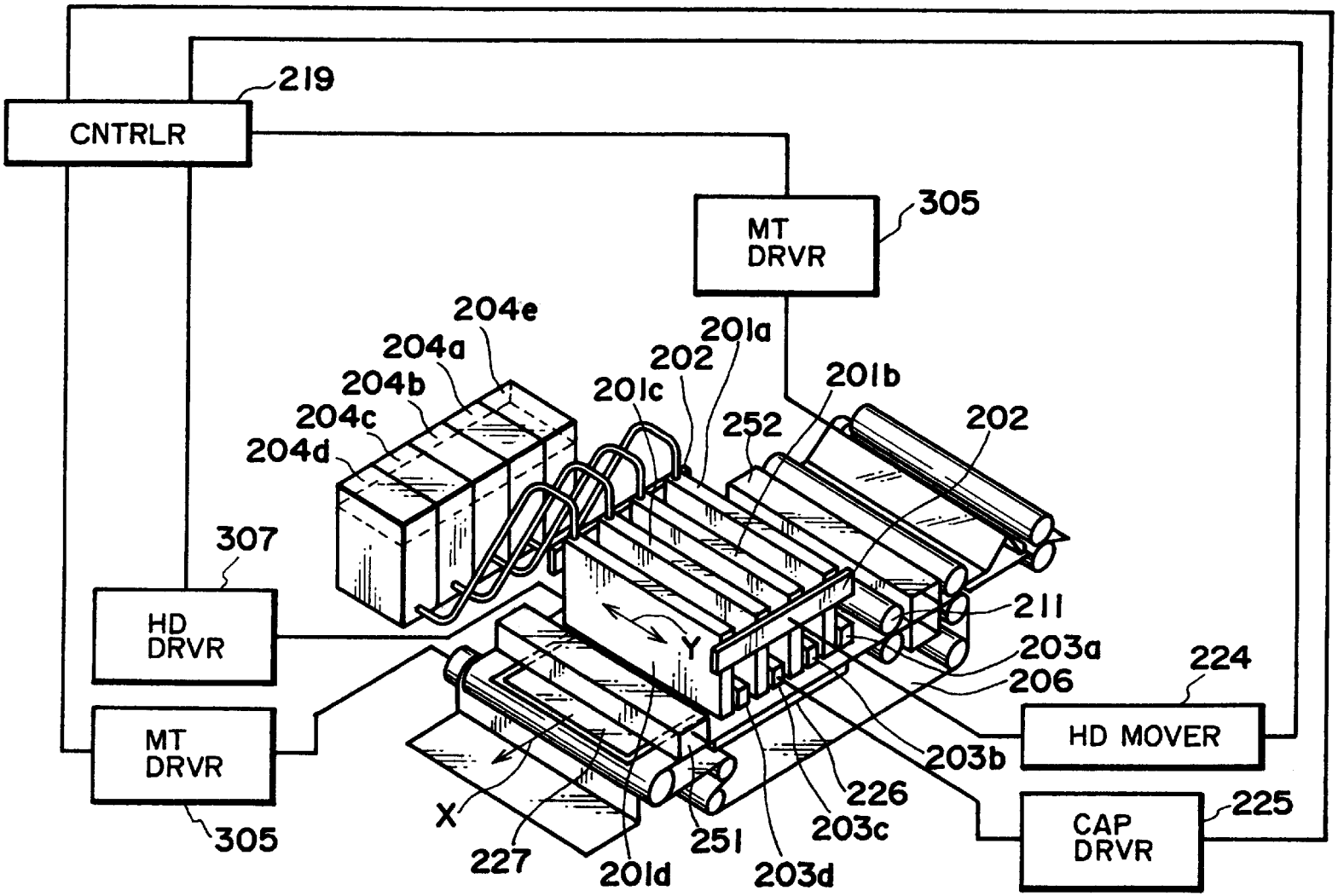
FIG. 22 is a schematic view of a liquid ejection recording system.

FIG. 22 is a schematic perspective view of an ink jet recording system employing the aforementioned liquid ejection head 201 in accordance with the present invention, and depicts its general structure. The liquid ejection head in this embodiment is a full-line type head, which comprises plural ejection orifices aligned with a density of 360 dpi so as to cover the entire recordable range. of the recording medium 150. It comprises four heads, which are correspondent to four colors; yellow (Y), magenta (M), cyan (C) and black (Bk). These four heads are fixedly supported by a holder 1202, in parallel to each other and with predetermined intervals.

These heads are driven in response to the signals supplied from a head driver 307, which constitutes means for supplying a driving signal to each head.

Each of the four color inks (Y, M, C and Bk) is supplied to a correspondent head from an ink container 204*a*, 204*b*, 205*c* or 204*d*. A reference numeral 204*e* designates a bubble generation liquid container from which the bubble generation liquid is delivered to each head.

Below each head, a head cap 203*a*, 203*b*, 203*c* or 203*d* is disposed, which contains an ink absorbing member composed of sponge or the like. They cover the ejection orifices of the corresponding heads, protecting the heads, and also maintaining the head performance, during a non-recording period.

A reference numeral 206 designates a conveyer belt, which constitutes means for conveying the various recording medium such as those described in the preceding embodiments. The conveyer belt 206 is routed through a predetermined path by various rollers, and is driven by a driver roller connected to a motor driver 305.

The ink jet recording system in this embodiment comprises a pre-printing processing apparatus 251 and a post-printing processing apparatus 252, which are disposed on the upstream and downstream sides, respectively, of the ink jet recording apparatus, along the recording medium conveyance path. These processing apparatuses 251 and 252 process the recording medium in various manners before or after recording is made, respectively.

The pre-printing process and the postprinting process vary depending on the type of recording medium, or the type of ink. For example, when recording medium composed of metallic material, plastic material, ceramic material or the like is employed, the recording medium is exposed to ultra-violet rays and ozone before printing, activating its surface.

In a recording material tending to acquire electric charge, such as plastic resin material, the dust tends to deposit on the surface by static electricity. The dust may impede the desired recording. In such a case, the use is made with ionizer to remove the static charge of the recording material, thus removing the dust from the recording material. When a textile is a recording material, from the standpoint of feathering prevention and improvement of fixing or the like, a pre-processing may be effected wherein alkali property substance, water soluble property substance, composition polymeric, water soluble property metal salt, urea, or thiourea is applied to the textile. The pre-processing is not limited to this, and it may be the one to provide the recording material with the proper temperature.

On the other hand, the post-processing is a process for imparting, to the recording material having received the ink, a heat treatment, ultraviolet radiation projection to promote the fixing of the ink, or a cleaning for removing the process material used for the pre-treatment and remaining because of no reaction.

In this embodiment, the head is a full line head, but the present invention is of course applicable to a serial type wherein the head is moved along a width of the recording material.

<Head Kit>

Figure 23:
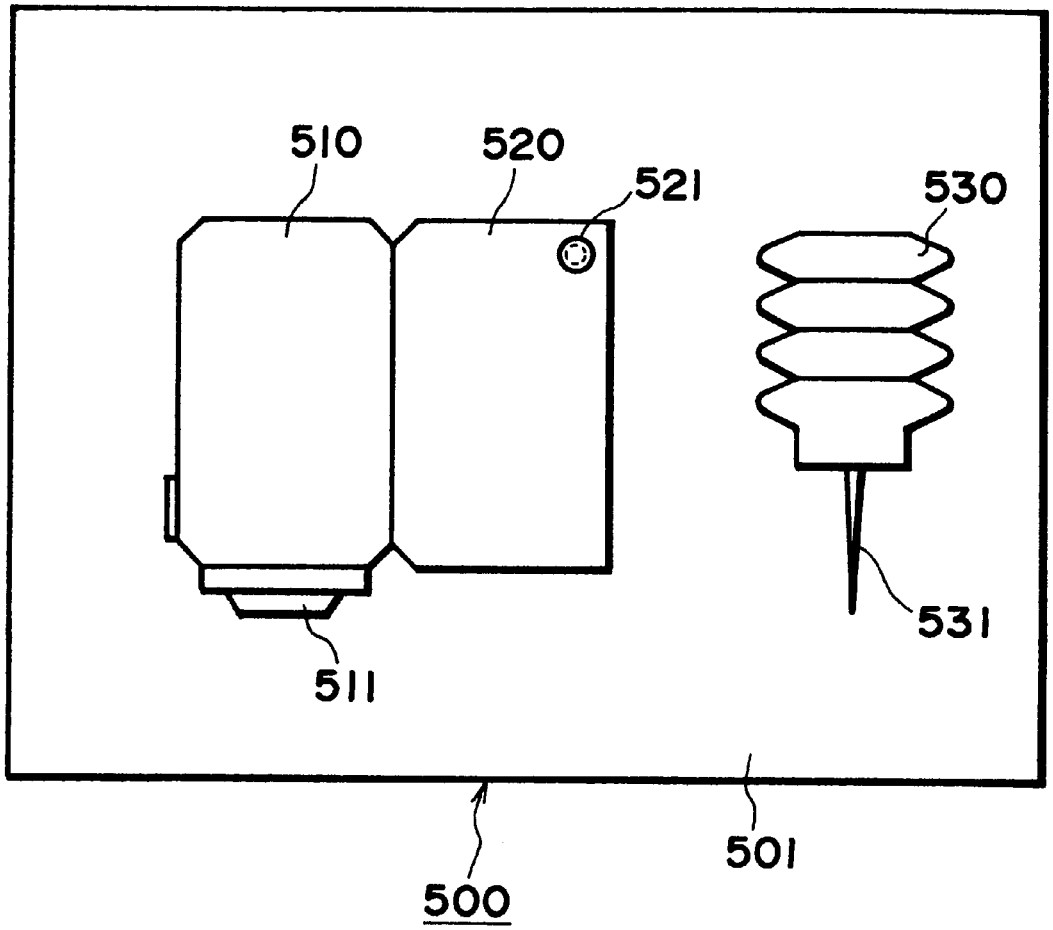
FIG. 23 is a schematic view of a head kit.

Hereinafter, a head kit will be described, which comprises the liquid ejection head in accordance with the present invention. FIG. 23 is a schematic view of such a head kit. This head kit is in the form of a head kit package 501, and contains: a head 510 in accordance with the present invention, which comprises an ink ejection section 511 for ejecting ink; an ink container 520, that is, a liquid container which is separable, or nonseparable, from the head; and ink filling means 530, which holds the ink to be filled into the ink container 520.

After the ink in the ink container 520 is completely depleted, the tip 530 (in the form of a hypodermic needle or the like) of the ink filling means is inserted into an air vent 521 of the ink container, the junction between the ink container and the head, or a hole drilled through the ink container wall, and the ink within the ink filling means is filled into the ink container through this tip 531.

When the liquid ejection head, the ink container, the ink filling means, and the like are available in the form of a kit contained in the kit package, the ink can be easily filled into the ink depleted ink container as described above; therefore, recording can be quickly restarted.

In this embodiment, the head kit contains the ink filling means. However, it is not mandatory for the head kit to contain the ink filling means; the kit may contain an exchangeable type ink container filled with the ink, and a head.

Even though FIG. 23 illustrates only the ink filling means for filling the printing ink into the ink container, the head kit may contain means for filling the bubble generation liquid into the bubble generation liquid container, in addition to the printing ink refilling means.

Figure 24:
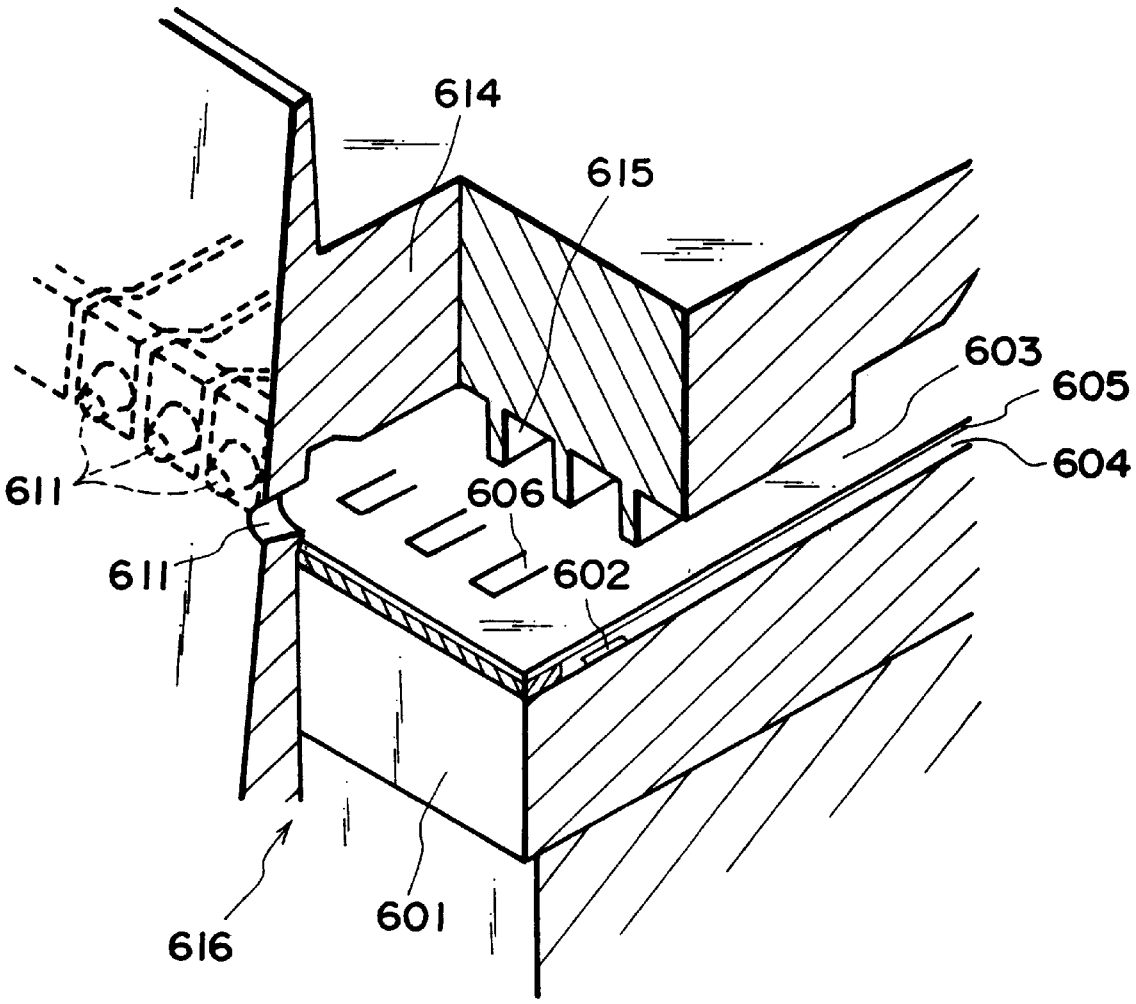
FIG. 24 is a partial perspective view of a liquid ejection head having a plurality of flows.

Referring to FIG. 24, the embodiment of the present invention will be further described. FIG. 24 shows a liquid ejection head 616 having a plurality of ejection outlets 611 and liquid passages in fluid communication therewith, respectively. The liquid ejection head 616 comprises a substrate 601 having a plurality of heat generating element 602, a separation wall 605 having movable members 606 corresponding to the heat generating elements, respectively, and a grooved top plate 614 has recesses constituting grooves (first liquid passages 603.

Figure 25:
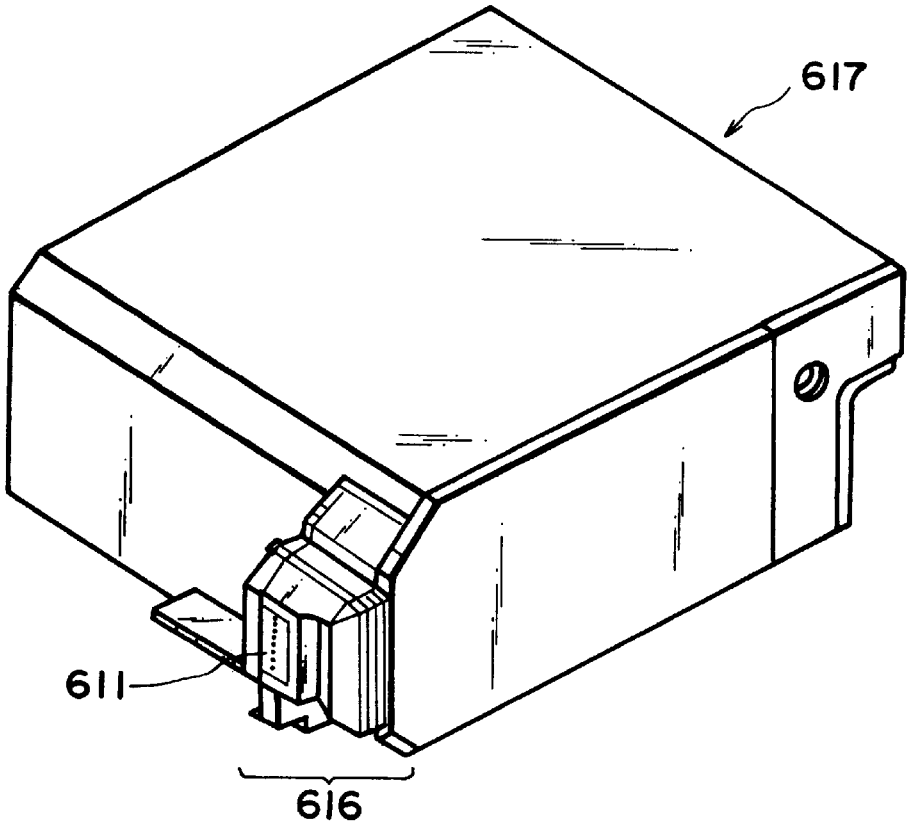
FIG. 25 shows a head cartridge.

FIG. 25 illustrates a head cartridge having a liquid ejection head 616 shown in FIG. 24 and an ink container for retaining liquid to be supplied to the liquid ejection head.

The ink container can be refilled with ink after the current ink is used up.

Figure 26:
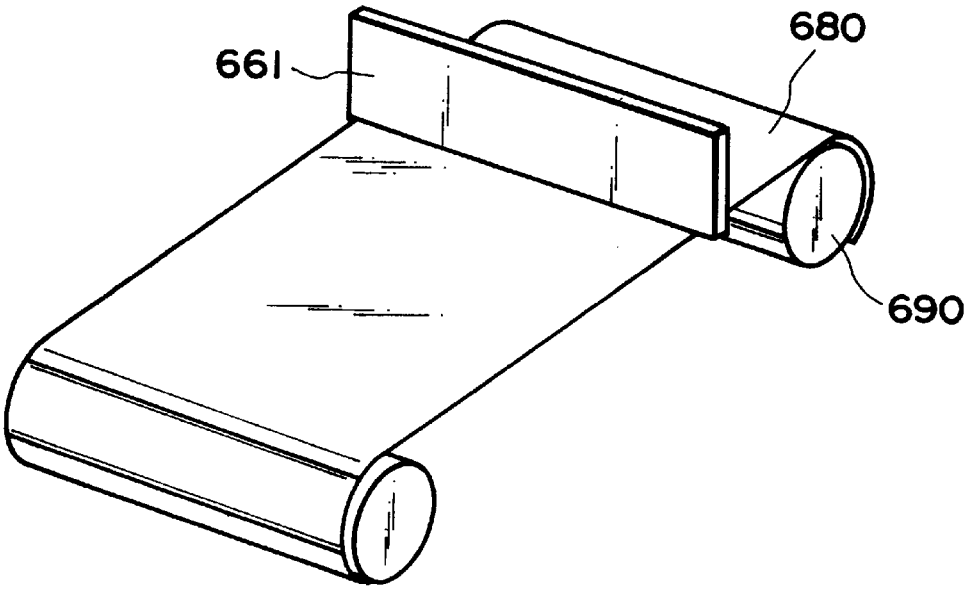
FIG. 26 illustrates a full-line type cartridge.

FIG. 26 shows a so-called full-line type head having a plurality of ejection outlet covering an entire recordable width of the recording material 680. In this Figure, designated by 661 is a full-line head, and it is moved relative to the recording material 680. Designated by 691 a feeding drum for feeding the recording material.

The description will be made has to proper mixture of the ejection liquid and the bubble generation liquid.

In this invention, both of the ejection liquid and the bubble generation liquid are ejected.

In this invention, the movable member is displaced sufficiently close to the ejection liquid passage (first liquid passage) to accomplish stabilized ejection. The mixture ratio of the ejection liquid and the bubble generation liquid is properly controlled by adjusting the open area of the above-described throat portion, by using proper material and configuration of the movable member to provide proper displacement thereof, by changing a pulse width or driving frequency of the signal applied to the heat generating element, and/or the like. In this embodiment, the pulse width is experiment and the driving frequency is increased to increase the mixture ratio of the liquid. Table 1 shows the results of experiments in a case wherein both of the bubble generating liquid and the ejection liquid are simultaneously ejected and in a case in which both of them are not ejected.

In this embodiment, the specification of the liquid ejection head was as follows, wherein the voltage of the signal applied to the heater was 23 V:

heater size: 58 $\mu$m×150 $\mu$m flexible member size: 53 $\mu$m×220 $\mu$m liquid path height: 15 $\mu$m The composition of the employed liquid (ink) to be ejected (hereinafter, ejection liquid) was as follows:

| | |
|---|---|
| dye | 3 wt. % |
| ethylene glycol | 6 wt. % |
| glycerin | 4 wt. % |
| urea | 4 wt. % |
| isopropyl alcohol | 5 wt. % |
| water | 78 wt. % |

The composition of the employed bubble generation liquid was as follows:

| | |
|---|---|
| ethanol | 40 wt. % |
| water | 60 wt. % |

As for the speed of the ejected liquid (liquid ejection speed), the liquid was ejected under a strobe light fired at a predetermined interval, and the distance traveled by the ejected liquid was observed using a microscope.

As for the optical density (OD), a solid image as printed on a sheet of recording medium, and the reflection density of the solid image was measured using a Macbeth densitometer RD-913 (product of a division of Kellmorgen Corporation), that is, a reflection density meter.

The weight of the ejected liquid was measured in the following manner. The bubble generation liquid and the ejection liquid were placed in separate measuring cylinders, and the rate of change in the volume of the liquid consumed during the liquid ejection was measured. Then, the weight of each ejected liquid was calculated in consideration of the specific weight of each liquid, obtaining the ratio of the liquid generation liquid to the ejection liquid. In this embodiment, the liquid was ejected 200,000 times, and the weight of the consumed amount of each liquid was measured using the above method.

TABLE 1

| Mixing ratio (wt. %) | Ejection speed (m/s) | Ejection stability | Optical density (OD) | Pulse width (ps) | Driving freq. (Hz) |
|---|---|---|---|---|---|
| 0 | 13–17 | F | 1.30 | 4.0 | 30 |
| 10 | 17 | G | 1.29 | 5.0 | 30 |
| 20 | 17 | E | 1.29 | 6.0 | 30 |
| 30 | 17 | E | 1.28 | 4.5 | 1000 |
| 50 | 17 | E | 1.25 | 5.5 | 6000 |
| 60 | 17 | E | 1.23 | 6.0 | 10000 |

Ejection stability
F: Quite unstable
G: A little instability
E: Little instability As is evident from Table 1, when the ratio of the bubble generation liquid to the ejection liquid (weight of the bubble generation liquid/weight of the ejection liquid) was set at 0 wt. %, and the liquid was continuously ejected for an extended period of time, the ejection speed sometimes fluctuated between 13 m/sec and 17 m/sec. However, as the ratio of the bubble generation liquid to the ejection liquid was increased, the fluctuation of the ejection speed was reduced. Further, Table 1 reveals that when the ejection speed is required to be stabilized at a high level, the mixing ratio of the bubble generation liquid to the ejection liquid is preferred to be 10 wt. % or more, more preferably, no less than 20 wt. %.

In the conventional bubble jet recording head, the ejection liquid is ejected using the pressure from the bubble formed by heating the ejection liquid itself. Therefore, it takes a relatively longer time for the heated ejection liquid to cool down to the initial temperature, resulting in that the following bubble generation begins while the liquid temperature is still high. It has been known that when the liquid is ejected in the condition described above, the amount by which the liquid is ejected greatly varies, or the ejection characteristics become unstable.

However, according to the present invention, the bubble generation liquid is ejected together with the ejection liquid; the bubble generation liquid, the temperature of which has increased, is discharged, allowing a fresh supply of the bubble generation liquid to move in, and therefore, preventing the temperature increase of the bubble generation liquid in the bubble generating region. As a result, the ejection becomes more stabilized.

Further, when air or the like is contained in the bubble generation liquid, it is liable that the air or the like becomes separated from the bubble generation liquid due to the heating, sometimes adhering to the surface of the heater, and when the separated air or the like adheres to the surface of the heater, the bubble generation performance becomes unstable; the ejection characteristics becomes unstable. For example, the amount by which the liquid is ejected, or the ejection speed, fluctuates. These problems can also be eliminated by preventing the temperature of the bubble generation liquid from increasing in the bubble generating region. In other words, they can be prevented by ejecting the bubble generation liquid together with the ejection liquid.

Further, the composition of the bubble generation liquid may be affected by the aforementioned heating or the like, and when the composition of the bubble generation liquid changes, the state of ejection changes sometimes, causing the ejection characteristic to change. This type of problem can also be solved by employing the ejection method in accordance with the present invention. In other words, when the bubble generation liquid is ejected (discharged) together with the ejection liquid, a new supply of the bubble generation liquid moves in, rendering the bubble generation liquid with the changed composition substantially nonexistent in the bubble generation region, improving the stability of the ejection characteristics.

Also referring to Table 1, the relationship between the mixing ratio of the bubble generation liquid to the ejection liquid, and the optical density (hereinafter, OD or OD value) will be described, wherein the dye concentration in the ejection liquid is 3 wt. %.

As the mixing ratio of the bubble generation liquid is increased, the OD value slightly decreases relative to the initial OD value, that is, the OD value correspondent to the bubble generation liquid mixing ratio of 0 wt. %, but as long as the bubble generation liquid mixing ratio remains no more than 50 wt. %, the OD value can be maintained at 1.25 or above. It should be noted here that as long as the OD values of printed characters or images are no less than 1.25, the characters or the images are perceived as the truly black characters or images; they are not perceived to be insufficiently black. In other words, a sufficiently high level of image quality can be maintained by keeping the mixing ratio of the bubble generation liquid at a level of no more than 50 wt. % so that the OD value remains no less than 1.25.

From the standpoint of the image density, the mixing ratio for the bubble generation liquid is preferred to be set at a level no more than 50 wt. %, wherein when the fluctuation of the image density is taken into consideration, it is preferred to be set at a level no more than 30 wt. %. Further, in view of the print quality, the ratio of the bubble generation liquid to the ejection liquid is preferred to be set within a range of 10–30 wt. %. Thus, when both the ejection stability and the print quality are taken into consideration, the mixing ratio of the bubble generation liquid to the ejection liquid is preferred to be no less than 10 wt. %, more preferably, no less than 20 wt. % and no more than 50 wt. %.

In this embodiment, an ink with a dye concentration of 3 wt. % was employed, but the present invention is not limited by this embodiment. For example, when ink having a dye concentration of no less than 3 wt. % is employed, it becomes easier to keep the OD value at a predetermined value or above; therefore, a high quality image can be more reliably produced. In other words, as long as the ejection characteristics and the reliability of the ejection are not deteriorated, the higher the ratio of the dye, the more stable the image density; when the ratio of the dye is not less than 5 wt. %, a preferable image density can be obtained even when the mixing ratio of the bubble generation liquid reaches 150 wt. %. On the contrary, when the mixing ratio of the bubble generation liquid is set at 20 wt. %, the OD value can be maintained at 1.25 or above even when the dye concentration is reduced to a point as low as 4%.

Further, the ejective properties of the ejection liquid can be improved by specifically matching the bubble generation liquid and the ejection liquid, and adjusting their mixing ratio at the time of ejection, so that the print quality can be improved.

Further, when the mixing ratio between the bubble generation liquid and the ejection liquid is optimum, the ejection characteristics are dependent upon the bubble generation pressure, the shape and the displacement of the flexible member, the height of the second liquid flow path, the size and the shape of the opening formed between the second liquid flow path and the first liquid flow path by the displacement of the flexible member, and the like factors; the ejection characteristics can be improved by adjusting the above factors. It should be noted here that when the coloring material concentration is within a range of 3–5 wt. %, the aforementioned mixing ratio of the bubble generation liquid is preferred to be within a range of 20–50 wt. %, and when the coloring material concentration is no less than 5 wt. %, the aforementioned mixing ratio is preferred to be within a range of 20–150 wt. %.

Further, even when both the employed ejection liquid and the bubble generation liquid are such a liquid that is not liable to leave deposit (baked-on deposited or the like) on the heating member as the bubble generating means, the above described effects can be obtained.

Embodiment 2

In this embodiment, an ejection liquid of a pigment dispersion type was employed to conduct the same experiments as those described in the first embodiment. The results are shown in Table 2. The composition of the employed pigment dispersion type ejection liquid was as follows, wherein a 40 wt. % aqueous solution of ethanol, the same solution as that employed in the first embodiment, was used:

| | |
|---|---|
| carbon black | 3 wt. % |
| glycerin | 10 wt. % |
| thioglycol | 6 wt. % |
| isopropyl alcohol | 2 wt. % |
| water | 74 wt. % |
| dispersant | 1 wt. % |

TABLE 2

| Mixing ratio (wt. %) | Ejection speed (m/s) | Ejection stability | Optical density (OD) | Pulse width (ps) | Driving freq. (Hz) |
|---|---|---|---|---|---|
| 0 | 10–15 | F | 1.30 | 4.0 | 30 |
| 10 | 15 | G | 1.29 | 5.0 | 30 |
| 20 | 15 | E | 1.29 | 6.0 | 30 |
| 30 | 15 | E | 1.29 | 4.5 | 1000 |
| 50 | 15 | E | 1.26 | 5.5 | 6000 |
| 60 | 15 | E | 1.24 | 6.0 | 10000 |

Also in this embodiment, the same results as those in the first embodiment were obtained. As evident from the table, when the ejective stability is required, the mixing ratio for the bubble generation liquid is preferred to be no less than 10 wt. %, more preferably, no less than 20 wt. %.

From the standpoint of the image quality, the mixing ratio for the bubble generation liquid is preferred to be kept at 50 wt. % or below so that the OD value can be maintained at 1.25 or above.

In other words, a high quality image can be obtained by keeping the mixing ratio for the bubble generation liquid at 10 wt. % or above, in particular, within a range of 20–50 wt. %.

Also in this embodiment, as in the first embodiment, the ejective properties of the ejection liquid can be improved by specifically matching the bubble generation liquid and the ejection liquid, and adjusting their mixing ratio at the time of ejection, so that the print quality can be improved. Further, the optimum mixing ratio of the bubble generation liquid to the ejection liquid is dependent upon the bubble generation pressure, the shape and the displacement of the flexible member, the height of the second liquid flow path, the size and the shape of the opening formed between the second liquid flow path and the first liquid flow path by the displacement of the flexible member, and the like factors; the mixing ratio is preferred to be adjusted in correspondence to the above factors.

Further, even when both the employed ejection liquid and the bubble generation liquid are such a liquid that is not liable to leave deposits (baked-on deposits or the like) on the heating member as the bubble generating means, the above-described effects can be obtained.

Embodiment 3

Figure 27:
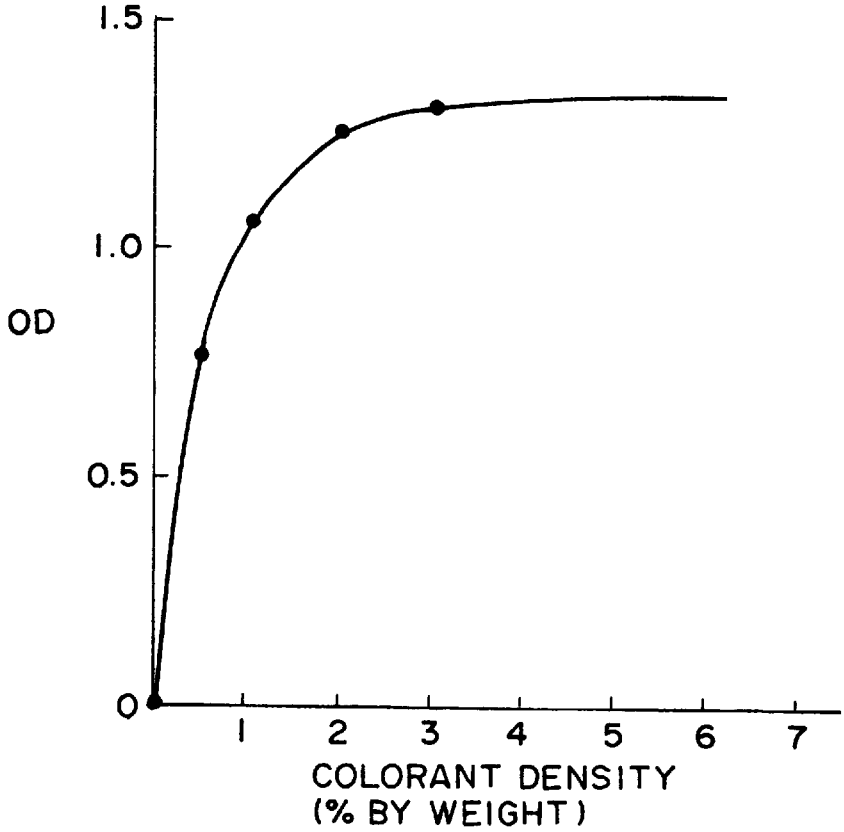
FIG. 27 shows a relation between density of colorant and OD level.

FIG. 27 depicts the relationship between the coloring material concentration and the OD value in the third embodiment of the present invention. As is evident from FIG. 27, when the coloring material concentration is no less than 3 wt. %, the rate of the OD value fluctuation is small, being near to a saturation point, and when the coloring material concentration is no more than 3 wt. %, the rate of the OD value fluctuation tends to increase. The absolute value of the rate of the OD value fluctuation is dependent upon the composition of the coloring material, the composition of the solvent, that is, the ejection liquid into which the coloring material is dissolved, the recording medium on which images are recorded, the amount of the ejection liquid ejected into the recording medium per unit area, and the like factors, but in relative terms, the OD value in this embodiment displayed a tendency similar to the above described one.

In this embodiment, the above described characteristic curve was utilized to realize the high print quality. That is, preferable density gradation was realized by utilizing a specific coloring material concentration range in which the rate of the OD value fluctuation increased, wherein the coloring material concentration was 1 wt. %. The specifications of the liquid ejection head employed in this embodiment were substantially the same as those given in the first embodiment except for the height of the second liquid flow path, which was 30 $\mu$m in this embodiment.

The composition of the ejection liquid was as follows:

| | |
|---|---|
| dye | 1 wt. % |
| ethylene glycol | 6 wt. % |
| glycerin | 4 wt. % |
| urea | 4 wt. % |
| isopropyl alcohol | 5 wt. % |
| water | 80 wt. % |

The composition of the bubble generation liquid was as follows:

| | |
|---|---|
| ethanol | 40 wt. % |
| water | 60 wt. % |

Table 3 presents the measured results of the experiment conducted in this embodiment, in which the above described ejection liquid with a dye concentration of 1 wt. % was employed, and the rate of the optical density (OD) fluctuation was measured while changing the mixing ratio of the bubble generation liquid to the ejection liquid.

TABLE 3

| Mixing ratio (% by weight) | Optical density (OD) | OD change (%) | Pulse width (ps) | Driving freq. (Hz) |
|---|---|---|---|---|
| 0 | 1.05 | 100 | 4.0 | 30 |
| 50 | 0.90 | 85.7 | 4.5 | 3000 |
| 100 | 0.76 | 72.4 | 5.0 | 6000 |
| 200 | 0.60 | 57.1 | 5.5 | 10000 |
| 300 | 0.50 | 47.6 | 6.0 | 15000 |

As is evident from Table 3, when the ejection liquid with the dye concentration of 1 wt. % was used, the OD value could be effectively adjusted to obtain the desirable image density gradation, by varying the mixing ratio for the bubble generation liquid. For example, when the bubble generation liquid was mixed by 300 wt. %, the OD value could be changed by approximately 50% in comparison to the OD value obtained when no bubble generation liquid was mixed.

Figure 28:
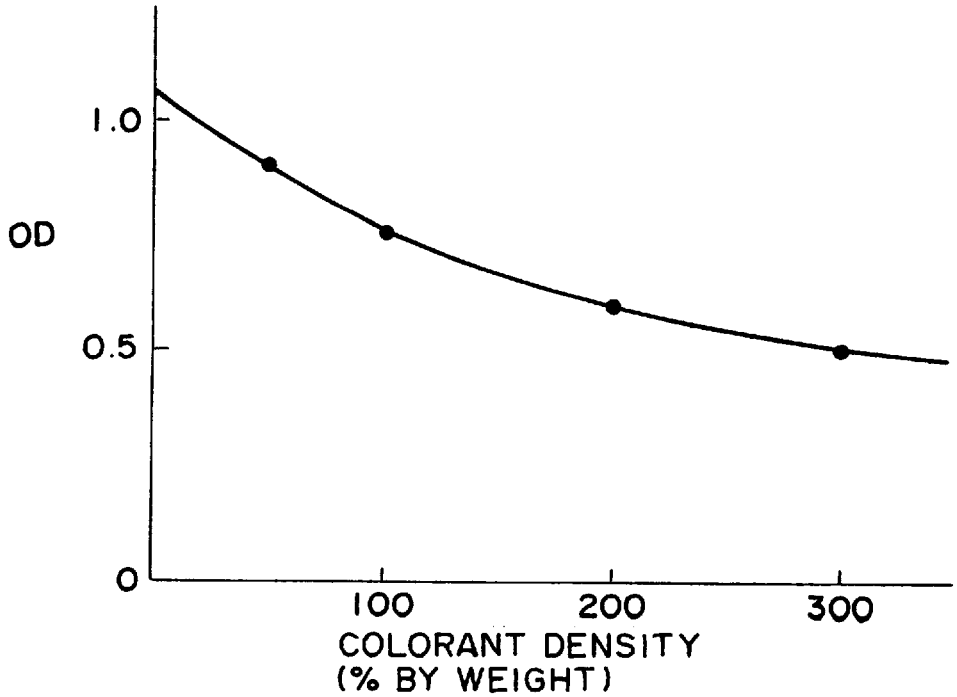
FIG. 28 shows a relation between content of ejection liquid and OD level.

FIG. 28 depicts the relationship between the mixing ratio for the bubble generation liquid and the optical density (OD) value, wherein the mixing ratio for the bubble generation liquid was varied based on the results given in Table 3. As is evident from FIG. 28, when the ejection liquid is ejected while varying the OD value, images with preferable gradation can be obtained.

According to this embodiment, as is evident from the characteristic curve given in FIG. 27, which shows the relationship between the coloring material concentration and the OD value, the image density gradation can be effectively controlled as long as the dye concentration is no more than 3 wt. %. This is because when the dye concentration of the bubble generation liquid is reduced to a point no more than 3 wt. %, the rate of the density change remarkable improved. Further, in order to effectively control the image density gradation, it is important that a coloring material concentration range of no less than 0.3 wt. % is employed. This is because when the coloring material concentration is no more than 0.3 wt. %, it may be impossible sometimes to obtain sufficient optical density for the dark areas of the image.

Further, the choice of the coloring material is not limited to dyes; the coloring material may be pigment as it was in the second embodiment.

Embodiment 4

Also in this embodiment, the same head as the head used in the first embodiment was used. As for the ejection liquid, a pigment ink containing C.I. pigment red 57 was employed, and as for the bubble generation liquid, a dye ink containing C.I. direct red was employed. Further, dispersant, water or a mixture of water miscible organic solvents, known viscosity regulator, surface tension regulator, pH regulator, binder, and the like were added to each ink. It should be noted here that the bubble jet head employs a system in which liquid is heated to generate bubbles wherein, and the liquid is ejected by the pressure from the bubble development; therefore, when a conventional bubble jet head is driven for an extended period of time to eject the pigment ink or the dye ink, the pigment ink is more liable to leave the deposit on the heater surface due to the aforementioned heating, and consequently, the ejection is liable to become more unstable. However, according to this embodiment, the dye ink is employed as the bubble generation liquid; therefore, the surface condition of the heating member can be kept substantially similar to when the dye ink alone is used as the ejection ink and the bubble generation liquid, and as a result, the ejection stability sustainable for a longer time can be provided.

In comparison to an image recorded using the dye ink, an image recorded using the pigment ink is superior in weather resistance such as water resistance or light resistance, but somewhat inferior in chromatic characteristics such as saturation. However, according to this embodiment, the pigment ink and the dye ink are mixed with each other while they are ejected through the movement of the flexible member. Therefore, it is possible to create an image benefiting from both characteristics of the pigment ink and the dye ink. In other words, an image superior in weather resistance as well as color reproductivity can be produced.

In addition, according to the present invention, the dye ink and the pigment ink are held in a substantially separated state, and are mixed as they are ejected; therefore, the agglutination of the pigment particle, which progressively occurs and increases the particle size when a specific combination of the dye ink and the pigment ink is left in a mixed state for a long period, does not occur, eliminating the possibility that the recording head be plugged with pigment particles of the increased size. As a result, the unstable ejection or the ejection failure, which otherwise might result from the plugging of the recording head by the pigment particles of the increased size, does not occur.

As for the choice of dye suitable to be combined with the pigment ink in order to obtain remarkable synergistic effects such as the improvement in the ejection stability or image quality, the following can be listed; direct dyes designated as C.I. direct reds 2, 20, 31, 46, 75 and 83; acidic dyes designated as C.I. acid reds 52. 92, 94, 106, 133, 154, 155, 249, 265 and 274; and basic dyes designated as C.I. basic reds 1, 2, 12, 13 and 14.

As for the choice of pigment preferably usable in conjunction with the present invention, the following can be listed; azo pigments designated as C.I. pigment reds 5, 11, 48, 49, 57, 60, 139, 144, 165 and 166; quinacridon pigments designated as C.I. pigment reds 122 and 209; perylene pigments designated as C.I. pigment red 123; and the like pigments.

According to this embodiment, not only can the ejection stability be improved, but also it is possible to make the most of one of the superior characteristics of the dye ink, that is, the superior color saturation, wherein in order to make the most effective use of the superior color saturation of the dye ink, the mixing ratio of the dye ink to the pigment ink was set at 10 wt. % or more.

As described above, according to the present invention, a liquid ejection head comprises a flexible member, wherein when the ejection liquid is ejected from a liquid ejection head, the free end of flexible member is displaced by the bubbles generated by heating the bubble generation liquid, whereby the bubble generation liquid is mixed into the ejection liquid at a predetermined ratio. As a result, the following effects can be obtained: the temperature increase of the bubble generation liquid, which occurs when the bubble generation liquid is heated to generate bubbles, can be reduced; the air or gas bubbles generated in the bubble generation liquid can be effectively discharged; the initial composition of the bubble generation liquid can be maintained; and the ejection can be stabilized in an optimum state.

In addition, when the color material concentration of the ejection liquid is kept within a range in which the OD value easily changes, the rate of the OD value fluctuation can be increased by mixing the bubble generation liquid; in other words, the image density gradation can be effectively controlled to produce a high quality image.

Further, according to the present invention, the bubble generation liquid and the ejection liquid are mixed in the liquid path, between the free end of the flexible member and the ejection orifice, and are ejected in the mixed state; therefore, highly uniform dots with well controlled density gradation can be formed.

While the invention has been described with reference to the structures disclosed herein, it is not confined to the details set forth and this application is intended to cover such modifications or changes as may come within the purposes of the improvements or the scope of the following claims.

What is claimed is:

1. A liquid ejecting method, comprising the steps of:

providing a liquid ejection outlet;

providing a first liquid flow path for a first liquid in fluid communication with said liquid ejection outlet, the first liquid flow path being disposed in a predetermined direction and terminating at the ejection outlet;

providing a second liquid flow path for a second liquid, adjacent to said first liquid flow path;

providing a separation wall having a movable member between said first liquid flow path and said second liquid flow path; and activating ejection energy generating means to pressurize the second liquid in said second liquid flow path to displace said movable member into said first liquid flow path to cause the second liquid to enter the first liquid flow path to be mixed with the first liquid in said first liquid flow path and to eject a mixture of the first and second liquids as an ejected mixed liquid through said ejection outlet generally in the predetermined direction, wherein a mixture ratio of the second liquid in the ejected mixed liquid is not less than 10% by weight of the first liquid based on the amount of the first liquid, wherein the first liquid and the second liquid are different liquids, wherein said movable member has a free end adjacent said liquid election outlet, wherein resistance in said first liquid flow path against said movable member in a direction of displacement of said movable member is greater adjacent a fulcrum portion of said movable member than adjacent the free end of said movable member, and wherein a bubble is generated in a bubble generation region in said second liquid flow path, and a pressure produced by the bubble displaces the free end of said movable member into said first liquid flow path, and the pressure is directed toward said election outlet of said first liquid flow path, thus electing the liquid.

2. A method according to claim 1, wherein an image recorded with the mixed liquid on a recording material has an OD value of not less than 1.25.

3. A method according to claim 1, wherein the first liquid contains pigment, and the second liquid contains dye.

4. A method according to claim 1, wherein said second liquid flow path is provided with bubble generating means.

5. A method according to claim wherein said bubble generating means includes thermal energy generation means.

6. A method according to claim 1, wherein said movable member is opposed to the bubble generation region, and wherein the bubble generated in the bubble generation region is expanded more toward downstream than toward upstream with respect to a direction toward said ejection outlet.

7. A method according to claim 1, wherein the amount of the second liquid in the mixture is not more than 50 weight %.

8. A method according to claim 1, wherein the amount of the second liquid in the mixture is not more than 30 weight %.

9. A method according to claim 1., wherein the amount of the second liquid in the mixture is not less than 20 weight %.

10. A method according to claim 1, wherein the amount of the second liquid in the mixture is more than 20 weight %.

11. A method according to claim 1, wherein the first liquid contains 3 to 5 weight % color material, and wherein the amount of the second liquid in the mixture is not less than 20 and not more than 50 weight %.

12. A method according to claim 1, wherein the first liquid contains more than 5 weight % color material, and wherein the amount of the second liquid in the mixture is not less than 20 and not more than 150 weight %.

13. A liquid ejection head, comprising:

a liquid ejection outlet;

a first liquid flow path for a first liquid in fluid communication with said liquid ejection outlet, said first liquid flow path being disposed in a predetermined direction and terminating at said ejection outlet;

a second liquid flow path for a second liquid, adjacent to said first liquid flow path;

a separation wall having a movable member between said first liquid flow path and said second liquid flow path; and means for controlling ejection energy generating means to pressurize the second liquid in said second liquid flow path to displace said movable member into said first liquid flow path to cause the second liquid to enter the first liquid flow path to be mixed with the first liquid in said first liquid flow path and to eject a mixture of the first and second liquids as an ejected mixed liquid through said ejection outlet generally in the predetermined direction, wherein a mixture ratio of the second liquid in the ejected mixed liquid is not less than 10% by weight of the first liquid based on the amount of the first liquid, wherein the first liquid and the second liquid are different liquids, wherein said movable member has a free end adjacent said liquid election outlet, wherein resistance in said first liquid flow path against said movable member in a direction of displacement of said movable member is greater adjacent a fulcrum portion of said movable member than adjacent the free end of said movable member, and wherein a bubble is generated in a bubble generation region in said second liquid flow path, and a pressure produced by the bubble displaces the free end of said movable member into said first liquid flow path, and the pressure is directed toward said election outlet of said first liquid flow path, thus ejecting the liquid.

14. A liquid ejecting apparatus, comprising:

a liquid ejecting head including a liquid ejection outlet, a first liquid flow path for a first liquid in fluid communication with said liquid ejection outlet, said first liquid flow path being disposed in a predetermined direction and terminating at said ejection outlet, a second liquid flow path for a second liquid, adjacent to said first liquid flow path, a separation wall having a movable member between said first liquid flow path and said second liquid flow path, and means for controlling ejection energy generating means to pressurize the second liquid in said second liquid flow path to displace said movable member into said first liquid flow path to cause the second liquid to enter the first liquid flow path to be mixed with the first liquid in said first liquid flow path and to eject a mixture of the first and second liquids as an ejected mixed liquid through said ejection outlet generally in the predetermined direction, wherein a mixture ratio of the second liquid in the ejected mixed liquid is not less than 10% by weight of the first liquid based on the amount of the first liquid; and driving signal supply means for supplying a driving signal to said liquid ejecting head, wherein the first liquid and the second liquid are different liquids, wherein said movable member has a free end adjacent said liquid election outlet, wherein resistance in said first liquid flow path against said movable member in a direction of displacement of said movable member is greater adjacent a fulcrum portion of said movable member than adjacent the free end of said movable member, and wherein a bubble is generated in a bubble generation region in said second liquid flow path, and a pressure produced by the bubble displaces the free end of said movable member into said first liquid flow path, and the pressure is directed toward said election outlet of said first liquid flow path, thus ejecting the liquid.

15. A liquid ejecting apparatus, comprising:

a liquid ejecting head including a liquid ejection outlet, a first liquid flow path for a first liquid in fluid communication with said liquid ejection outlet, said first liquid flow path being disposed in a predetermined direction and terminating at said ejection outlet, a second liquid flow path for a second liquid, adjacent to said first liquid flow path, a separation wall having a movable member between said first liquid flow path and said second liquid flow path; and driving signal supply means for supplying to said liquid ejecting head a driving signal to activate ejection energy generating means to pressurize the second liquid in said second liquid flow path to displace said movable member into said first liquid flow path to cause the second liquid to enter the first liquid flow path to be mixed with the first liquid in said first liquid flow path and to eject a mixture of the first and second liquids as an ejected mixed liquid through said ejection outlet generally in the predetermined direction, wherein a mixture ratio of the second liquid in the ejected mixed liquid is not less than 10% by weight of the first liquid based on the amount of the first liquid, wherein the first liquid and the second liquid are different liquids, wherein said movable member has a free end adjacent said liquid election outlet, wherein resistance in said first liquid flow path against said movable member in a direction of displacement of said movable member is greater adjacent a fulcrum portion of said movable member than adjacent the free end of said movable member, and wherein a bubble is generated in a bubble generation region in said second liquid flow path, and a pressure produced by the bubble displaces the free end of said movable member into said first liquid flow path, and the pressure is directed toward said election outlet of said first liquid flow path, thus electing the liquid.

16. A head cartridge, comprising:

a liquid ejecting head including a liquid ejection outlet, a first liquid flow path for a first liquid in fluid communication with said liquid ejection outlet, said first liquid flow path being disposed in a predetermined direction and terminating at said ejection outlet, a second liquid flow path for a second liquid, adjacent to said first liquid flow path, a separation wall having a movable member between said first liquid flow path and said second liquid flow path, and means for controlling ejection energy generating means to pressurize the second liquid in said second liquid flow path to displace said movable member into said first liquid flow path to cause the second liquid to enter the first liquid flow path to be mixed with the first liquid in said first liquid flow path and to eject a mixture of the first and second liquids as an ejected mixed liquid through said ejection outlet generally in the predetermined direction, wherein a mixture ratio of the second liquid in the ejected mixed liquid is not less than 10% by weight of the first liquid based on the amount of the first liquid; and a liquid container for containing the first and second liquids to be supplied to said liquid ejecting head, wherein the first liquid and the second liquid are different liquids, wherein said movable member has a free end adjacent said liquid ejection outlet, wherein resistance in said first liquid flow path against said movable member in a direction of displacement of said movable member is greater adjacent a fulcrum portion of said movable member than adjacent the free end of said movable member, and wherein a bubble is generated in a bubble generation region in said second liquid flow path, and a pressure produced by the bubble displaces the free end of said movable member into said first liquid flow path, and the pressure is directed toward said election outlet of said first liquid flow path, thus electing the liquid.

17. A print comprising a recording material and coloring material ejected onto the recording material through the steps of:

providing a liquid ejection outlet;

providing a first liquid flow path for a first liquid in fluid communication with said liquid ejection outlet, the first liquid flow path being disposed in a predetermined direction and terminating at the ejection outlet;

providing a second liquid flow path for a second liquid, adjacent to said first liquid flow path;

providing a separation wall having a movable member between said first liquid flow path and said second liquid flow path; and activating ejection energy generating means to pressurize the second liquid in said second liquid flow path to displace said movable member into said first liquid flow path to cause the second liquid to enter the first liquid flow path to be mixed with the first liquid in said first liquid flow path and to eject a mixture of the first and second liquids as an ejected mixed liquid through said ejection outlet generally in the predetermined direction, wherein a mixture ratio of the second liquid in the ejected mixed liquid is not less than 10% by weight of the first liquid based on the amount of the first liquid, wherein the first liquid and the second liquid are different liquids, wherein said movable member has a free end adjacent said liquid election outlet, wherein resistance in said first liquid flow path against said movable member in a direction of displacement of said movable member is greater adjacent a fulcrum portion of said movable member than adjacent the free end of said movable member, and wherein a bubble is generated in a bubble generation region in said second liquid flow path, and a pressure produced by the bubble displaces the free end of said movable member into said first liquid flow path, and the pressure is directed toward said ejection outlet of said first liquid flow path, thus electing the liquid.

18. A head kit comprising:

a recording head including a liquid ejection outlet, a first liquid flow path for a first liquid in fluid communication with said liquid ejection outlet, said first liquid flow path being disposed in a predetermined direction and terminating at said ejection outlet, a second liquid flow path for a second liquid, adjacent to said first liquid flow path, a separation wall having a movable member between said first liquid flow path and said second liquid flow path, and means for controlling ejection energy generating means to pressurize the second liquid in said second liquid flow path to displace said movable member into said first liquid flow path to cause the second liquid to enter the first liquid flow path to be mixed with the first liquid in said first liquid flow path and to eject a mixture of the first and second liquids as an ejected mixed liquid through said ejection outlet generally in the predetermined direction, wherein a mixture ratio of the second liquid in the ejected mixed liquid is not less than 10% by weight of the first liquid based on the amount of the first liquid;

a liquid container for containing the liquids to be supplied to said recording head; and a filling portion, containing the liquids, for filling the liquids to said liquid container, wherein the first liquid and the second liquid are different liquids, wherein said movable member has a free end adjacent said liquid ejection outlet, wherein resistance in said first liquid flow path against said movable member in a direction of displacement of said movable member is greater adjacent a fulcrum portion of said movable member than adjacent the free end of said movable member, and wherein a bubble is generated in a bubble generation region in said second liquid flow path, and a pressure produced by the bubble displaces the free end of said movable member into said first liquid flow path, and the pressure is directed toward said election outlet of said first liquid flow path, thus electing the liquid.

19. A liquid filling method, comprising the steps of:

preparing a recording head including a liquid ejection outlet, a first flow path for a first liquid in fluid communication with said liquid ejection outlet, the first liquid flow path being disposed in a predetermined direction and terminating at the ejection outlet, a second liquid flow path for a second liquid, adjacent to said first liquid flow path, a separation wall having a movable member between said first liquid flow path and said second liquid flow path, and means for controlling ejection energy generating means to pressurize the second liquid in said second liquid flow path to displace said movable member into said first liquid flow path to cause the second liquid to enter the first liquid flow path to be mixed with the first liquid in said first liquid flow path and to eject a mixture of the first and second liquids as an ejected mixed liquid through said ejection outlet generally in the predetermined direction, wherein a mixture ratio of the second liquid in the ejected mixed liquid is not less than 10% by weight of the first liquid based on the amount of the first liquid; and filling the liquids in both of said first liquid flow path and said second liquid flow path, wherein the first liquid and the second liquid are different liquids, wherein said movable member has a free end adjacent said liquid election outlet, wherein resistance in said first liquid flow path against said movable member in a direction of displacement of said movable member is greater adjacent a fulcrum portion of said movable member than adjacent the free end of said movable member, and wherein a bubble is generated in a bubble generation region in said second liquid flow path, and a pressure produced by the bubble displaces the free end of said movable member into said first liquid flow path, and the pressure is directed toward said election outlet of said first liquid flow path, thus electing the liquid.

20. A tone gradation recording method comprising the steps of:

providing a liquid ejection outlet;

providing a first liquid flow path for a first liquid in fluid communication with said liquid ejection outlet, the first liquid flow path being disposed in a predetermined direction and terminating at the ejection outlet;

providing a second liquid flow path for a second liquid, adjacent to said first liquid flow path;

providing a separation wall having a movable member between said first liquid flow path and said second liquid flow path;

activating ejection energy generating means for pressurizing the second liquid in said second liquid flow path to displace said movable member into said first liquid flow path to cause the second liquid to enter the first liquid flow path to be mixed with the first liquid in said first liquid flow path and to eject a mixture of the first and second liquids as an ejected mixed liquid through said ejection outlet generally in the predetermined direction; and controlling a mixture ratio of the second liquid in the ejected mixed liquid, wherein the first liquid and the second liquid are different liquids, wherein said movable member has a free end adjacent said liquid election outlet, wherein resistance in said first liquid flow path against said movable member in a direction of displacement of said movable member is greater adjacent a fulcrum portion of said movable member than adjacent the free end of said movable member, and wherein a bubble is generated in a bubble generation region in said second liquid flow path, and a pressure produced by the bubble displaces the free end of said movable member into said first liquid flow path, and the pressure is directed toward said election outlet of said first liquid flow path, thus electing the liquid.

21. A method according to claim 20, wherein the first liquid contains 0.3 to 3 weight % of color material.

22. A tone recording apparatus comprising:

a liquid ejection outlet;

a first liquid flow path for a first liquid in fluid communication with said liquid ejection outlet, the first liquid flow path being disposed in a predetermined direction and terminating at the ejection outlet;

a second liquid flow path for a second liquid, adjacent to said first liquid flow path;

a separation wall having a movable member between said first liquid flow path and said second liquid flow path;

ejection energy generating means for pressurizing the second liquid in said second liquid flow path to displace said movable member into said first liquid flow path to cause the second liquid to enter the first liquid flow path to be mixed with the first liquid in said first liquid flow path and to eject a mixture of the first and second liquids as an ejected mixed liquid through said ejection outlet generally in the predetermined direction; and control means for controlling a mixture ratio of the second liquid in the ejected mixed liquid, wherein the first liquid and the second liquid are different liquids, wherein said movable member has a free end adjacent said liquid election outlet, wherein resistance in said first liquid flow path against said movable member in a direction of displacement of said movable member is greater adjacent a fulcrum portion of said movable member than adjacent the free end of said movable member, and wherein a bubble is generated in a bubble generation region in said second liquid flow path, and a pressure produced by the bubble displaces the free end of said movable member into said first liquid flow path, and the pressure is directed toward said election outlet of said first liquid flow path, thus electing the liquid.

23. An apparatus according to claim 22, wherein the first liquid contains 0.3 to 3 weight % of color material.

24. An apparatus according to claim 24, wherein said second liquid flow path is provided with said ejection energy generating means to form bubbles.

25. An apparatus according to claim 24, wherein said ejection energy generating means comprises thermal energy generation means.

* * * * *

UNITED STATES PATENT AND TRADEMARK OFFICE

CERTIFICATE OF CORRECTION

PATENT NO. : 6,084,616

DATED : July 4, 2000

INVENTOR(S) : NAKATA ET AL.

It is certified that error appears in the above-identified patent and that said Letters Patent is hereby corrected as shown below:

COLUMN 1:
Line 19, "liquid" should read --a liquid--.
Line 21, "tion" should read --ting--.

COLUMN 2:
Line 1, "image" should be deleted.
Line 23, "through" should read --Although--.
Line 31, "if" should read --If--.
Line 51, "accomplished," should read --accomplished--.

COLUMN 3:
Line 34, "it is" should read --It is--.

COLUMN 4:
Line 1, "including;" should read --including--.
Line 28, "including;" should read --including--.

COLUMN 5:
Line 47, "ejection" should read --ejected--.

COLUMN 6:
Line 26, "are a" should read --are-- and "view" should read --views--.
Line 53, "is an illustration" should be deleted.

COLUMN 7:
Line 4, "17(a)-17(d)" should read --18(a)-18(d)--.
Line 67, "33. the" should read --33. The--.

UNITED STATES PATENT AND TRADEMARK OFFICE

CERTIFICATE OF CORRECTION

PATENT NO. : 6,084,616

DATED : July 4, 2000

INVENTOR(S) : NAKATA ET AL.

It is certified that error appears in the above-identified patent and that said Letters Patent is hereby corrected as shown below:

COLUMN 8:
Line 11, "flow.path" should read --flow path--.
Line 25, "1(a)" should read --1(b)--.
Line 32, "important" should read --the important--.
Line 57, "it directly" should read --it is directly--.

COLUMN 9:
Line 5, "to to" should read --to--.
Line 15, "FIG. 1(b)" should read --FIG. 1(a)--.
Line 31, "of of" should read --of--.

COLUMN 10:
Line 4, "bubble," should read --the bubble,--.
Line 54, "Addition ally," should read --Additionally,--.

COLUMN 13:
Line 18, "2. the" should read --2. The--.
Line 66, "ejected. for" should read --ejected. For--.

COLUMN 14:
Line 12, "embodiment," should read --embodiment;--.

COLUMN 15:
Line 17, "bubble," should read --the bubble,--.
Line 19, "of of" should read --of--.
Line 38, "of easiness" should read --easiness--.

UNITED STATES PATENT AND TRADEMARK OFFICE

CERTIFICATE OF CORRECTION

PATENT NO. : 6,084,616

DATED : July 4, 2000

INVENTOR(S) : NAKATA ET AL.

It is certified that error appears in the above-identified patent and that said Letters Patent is hereby corrected as shown below:

COLUMN 16:
Line 20, "poly—sulfone" should read --polysulfone--.
Line 32, "μm" should read --cm--.

COLUMN 17:
Line 10, "layer," should read --layer--.
Line 27, "selective" should read --selectively--.

COLUMN 18:
Line 13, "exemplification, but" should read --exemplification;--.

COLUMN 19:
Line 56, "includes:" should read --include:--.

COLUMN 20:
Line 34, "view" should read --views--.
Line 45, "contactness" should read --contact--.
Line 47, "contactness" should read --contact--.
Line 56, "substrate1" should read --substrate 1--.
Line 60, "is illuminated" should read --are illuminated--.
Line 62, "using" should read --(using--.
Line 63, "from," should read --from--.

UNITED STATES PATENT AND TRADEMARK OFFICE

CERTIFICATE OF CORRECTION

PATENT NO. : 6,084,616

DATED : July 4, 2000

INVENTOR(S) : NAKATA ET AL.

It is certified that error appears in the above-identified patent and that said Letters Patent is hereby corrected as shown below:

COLUMN 21:
Line 4, "residuals" should read --residual--.
Line 7, "sec," should read --sec.,--.
Line 8, "2" should read --2--.
Line 25, "member" should read --members--.
Line 32, "silicone)." should read --Silicone).--.
Line 48, "laminated. it" should read --laminated. It--.
Line 50, "eximer" should read --excimer--.

COLUMN 22:
Line 24, "JAPAN," should read --JAPAN),--.

COLUMN 23:
Line 36, "grooved and the" should read --grooved member 50 and the--.
Line 56, "supply and 21" should read --supply passages 20 and 21--.

COLUMN 25:
Line 24, "range." should read --range--.
Line 35, "205c" should read --204c--.
Line 46, "medium" should read --media--.

COLUMN 26:
Line 64, "603." should read --603).--.

COLUMN 27:
Line 4, "outlet" should read --outlets--.
Line 7, "691 a" should read --691 is a--.
Line 9, "has" should read --as--.

UNITED STATES PATENT AND TRADEMARK OFFICE

CERTIFICATE OF CORRECTION

PATENT NO. : 6,084,616

DATED : July 4, 2000

INVENTOR(S) : NAKATA ET AL.

It is certified that error appears in the above-identified patent and that said Letters Patent is hereby corrected as shown below:

COLUMN 28:
Line 10, "(ps)" should read --(μs)--.
Line 58, "becomes" should read --become--.

COLUMN 30:
Line 38, "(ps)" should read --(μs)--.

COLUMN 32:
Line 5, "(ps)" should read --(μs)--.
Line 34, "remarkable" should read --remarkably--.
Line 54, "wherein," should read --therein,--.

COLUMN 33:
Line 8, "benefiting" should read --benefitting--.
Line 26, "listed;" should read --listed:--.
Line 28, "52." should read --52,--.
Line 33, "listed;" should read --listed:--.

COLUMN 34:
Line 37, "election" should read --ejection--.
Line 46, "election" should read --ejection--.
Line 47, "electing" should read --ejecting--.
Line 56, "claim" should read --claim 4,--.

UNITED STATES PATENT AND TRADEMARK OFFICE

CERTIFICATE OF CORRECTION

PATENT NO. : 6,084,616

DATED : July 4, 2000

INVENTOR(S) : NAKATA ET AL.

It is certified that error appears in the above-identified patent and that said Letters Patent is hereby corrected as shown below:

COLUMN 35:
Line 4, "1.," should read --1,--.
Line 42, "election" should read --ejection--.
Line 51, "election" should read --ejection--.

COLUMN 36:
Line 12, "election" should read --ejection--.
Line 21, "election" should read --ejection--.
Line 50, "election" should read --ejection--.
Line 59, "election" should read --ejection--.
Line 60, "electing" should read --ejecting--.

COLUMN 37:
Line 30, "election" should read --ejection--.
Line 31, "electing" should read --ejecting--.
Line 61, "election" should read --ejection--.

COLUMN 38:
Line 4, "electing" should read --ejecting--.
Line 43, "election" should read --ejection--.
Line 44, "electing" should read --ejecting--.

COLUMN 39:
Line 5, "election" should read --ejection--.
Line 14, "election" should read --ejection--.
Line 15, "electing" should read --ejecting--.
Line 43, "election" should read --ejection--.

UNITED STATES PATENT AND TRADEMARK OFFICE

CERTIFICATE OF CORRECTION

PATENT NO. : 6,084,616

DATED : July 4, 2000

INVENTOR(S) : NAKATA ET AL.

It is certified that error appears in the above-identified patent and that said Letters Patent is hereby corrected as shown below:

COLUMN 40:

Line 2, "election" should read --ejection--.
Line 3, "electing" should read --ejecting--.
Line 29, "election" should read --ejection--.
Line 38, "election" should read --ejection--.
Line 39, "electing" should read --ejecting--.
Line 43, "claim 24," should read --claim 22,--.

Signed and Sealed this

Eighth Day of May, 2001

*Attest:*

Nicholas P. Godici

NICHOLAS P. GODICI

*Attesting Officer*

*Acting Director of the United States Patent and Trademark Office*